US012523236B2

(12) United States Patent
Patrick

(10) Patent No.: US 12,523,236 B2
(45) Date of Patent: Jan. 13, 2026

(54) SINUSOIDAL BLADE APPARATUS

(71) Applicant: David M. Patrick, Ladera Ranch, CA (US)

(72) Inventor: David M. Patrick, Ladera Ranch, CA (US)

( * ) Notice: Subject to any disclaimer, the term of this patent is extended or adjusted under 35 U.S.C. 154(b) by 0 days.

(21) Appl. No.: 18/450,918

(22) Filed: Aug. 16, 2023

(65) Prior Publication Data

US 2024/0060504 A1 Feb. 22, 2024

Related U.S. Application Data

(60) Provisional application No. 63/371,573, filed on Aug. 16, 2022.

(51) Int. Cl.
*F04D 29/28* (2006.01)
*F04D 17/00* (2006.01)

(52) U.S. Cl.
CPC ..... *F04D 29/281* (2013.01); *F04D 17/00* (2013.01)

(58) Field of Classification Search
CPC .... F04D 29/281; F04D 29/30; F04D 29/2216; F01D 5/141; F05D 2250/184
See application file for complete search history.

(56) References Cited

U.S. PATENT DOCUMENTS 6,908,287 B2 * 6/2005 Cho ..... F04D 29/326 416/189
7,121,807 B2 * 10/2006 Cho ..... F04D 29/384 416/DIG. 2
8,668,460 B2 * 3/2014 Han ..... F04D 29/30 416/241 R
11,255,341 B1 * 2/2022 Cheng ..... F04D 29/30
11,371,529 B2 * 6/2022 Loercher ..... F04D 29/324
2006/0056964 A9 3/2006 Tamagawa et al.
2011/0000314 A1 1/2011 Georgakopoulos
2012/0321494 A1 12/2012 Duke et al.
2014/0127029 A1 * 5/2014 Yang ..... F04D 29/281 416/223 B (Continued)

OTHER PUBLICATIONS

Patent Cooperation Treaty, International Search Report, Nov. 16, 2023.

(Continued)

*Primary Examiner* — Courtney D Heinle
*Assistant Examiner* — Cameron A Corday
(74) *Attorney, Agent, or Firm* — CIONCA IP Law P.C.

(57) ABSTRACT

An apparatus for manipulating a substance, the apparatus having a blade having: a fin hub associated with a fin formed by a sinusoidal outer edge and an inner surface extending from the sinusoidal edge to a center of the fin, the fin hub being associated with a portion of the sinusoidal outer edge of the fin, such that to cause the fin hub and the fin to rotate simultaneously about a rotational axis that is coaxial with the fin hub; wherein, said substance is simultaneously pulled in via two opposing vortexes that are coaxial with the rotational axis, toward said portion of the sinusoidal outer edge of the fin, and said substance is also simultaneously push out 360 degrees around and away from the rotational axis. The blade is configured to axially intake and radially output a substance, such as air, for rapid, efficient mixing of said substance.

20 Claims, 17 Drawing Sheets

(56) References Cited

U.S. PATENT DOCUMENTS

| | | | | |
|---|---|---|---|---|
| 2015/0308452 | A1* | 10/2015 | Son | B23K 26/32 416/182 |
| 2019/0136866 | A1* | 5/2019 | Kedelty | F04D 17/08 |
| 2023/0337391 | A1* | 10/2023 | Lin | H05K 7/20172 |

OTHER PUBLICATIONS

Patent Cooperation Treaty, Written Opinion of the International Searching Authority, Nov. 16, 2023.

* cited by examiner

SINUSOIDAL BLADE APPARATUS

CROSS-REFERENCE TO RELATED APPLICATIONS

This application claims the benefit of U.S. Provisional Application No. 63/371,573, filed Aug. 16, 2022, which is hereby incorporated by reference, to the extent that it is not conflicting with the present application.

BACKGROUND OF INVENTION

1. Field of the Invention

The invention relates generally to substance manipulating apparatuses and specifically to substance manipulating apparatuses having a sinusoidal blade.

2. Description of the Related Art

Rotary blades are commonly used in apparats such as fans and mixers to manipulate and mix fluids. These apparats are configured to intake or ingest a fluid, such as air, from a certain direction and output said fluid in another direction, in order to provide a desired function, such as cooling a room. However, in many applications, a singular device having a singular blade may prove to be ineffective at mixing and redirecting a fluid that it takes in, due in part to the blade's inability to guide the emitted fluid over a sufficiently large area. This in turn may result in slower, less efficient fluid mixing. Additional structures may be used to manipulate the direction that the emitted fluid travels by actively manipulating the position or rotation of the apparatus, but such features may complicate said apparatus and said approach may not be viable in all applications.

Therefore, there is a need to solve the problems described above by proving a device and method for a substance manipulating apparatus having a blade configured to intake substances axially and expel substances radially as it rotates to facilitate rapid, efficient mixing of substances.

The aspects or the problems and the associated solutions presented in this section could be or could have been pursued; they are not necessarily approaches that have been previously conceived or pursued. It should be understood that structural and/or logical modifications could be made by someone of ordinary skills in the art without departing from the scope of the invention. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a radial emission blade is provided, the radial emission blade comprising: a fin having: a sinusoidal outer edge; and an inner surface extending from the sinusoidal edge to the center of the fin, wherein the fin is associated with a fin hub. Thus, an advantage is that the radial emission blade is configured to intake axially disposed fluid and redirect it radially away from the axis of blade rotation. This in turn allows for efficient distribution of the fluid, solid or other substance over a wide area, thus facilitating fast and efficient substance mixing. When used within a fan, this radial emission blade may intake axially disposed air, mix it and emit it radially away from the axis of rotation, thus emitting fluids over a 360 degrees range around a corresponding apparatus. The sinusoidal outer edge of each fin of the radial emission blade, and complementary inner surface enclosed within each fin, may facilitate the radial distribution of axially ingested fluids while limiting the amount components required to do so, thus simplifying the overall structure of the blade and the corresponding apparatus.

In another aspect, the pitch angle of each fin of the radial emission blade may be adjusted to manipulate the range over which axially disposed fluids are taken in and outgoing fluids are radially emitted. Thus, an advantage is that the intake and output operating parameters of the blade may be adjusted based on the needs of the application.

In another aspect, each of the fins of the radial emission blade may be configured to be removed from said blade. Thus, an advantage is that the fins of the radial emission blade may be adjusted and/or easily replaced without needing to replace the entire blade.

In another aspect, the disclosed radial emission blade may be utilized within a radial emission fan. Thus, an advantage is that the radial emission fan may be provided with a plurality of functional elements that work in conjunction with or are further enhanced by the rotation of the radial emission blade. In an embodiment, a fan base of the fan body may be provided with an accessory pod having a scent, wherein the accessory pod is axially disposed to the radial emission fan. As such, a scent emitted by the accessory pod may be pulled into the radial emission blade and distributed radially outward away from the axis of rotation, thus facilitating effective distribution of the scent. A heating or cooling element axially disposed to the blade may also have its resultant product efficiently distributed in a radial 360-degree angle around the axis of rotation away from the radial emission fan. Another advantage is that the radial emission fan may effectively filter the air by providing a filter around the radial emission blade, thus forcing unfiltered, axially ingested air radially through said filter.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
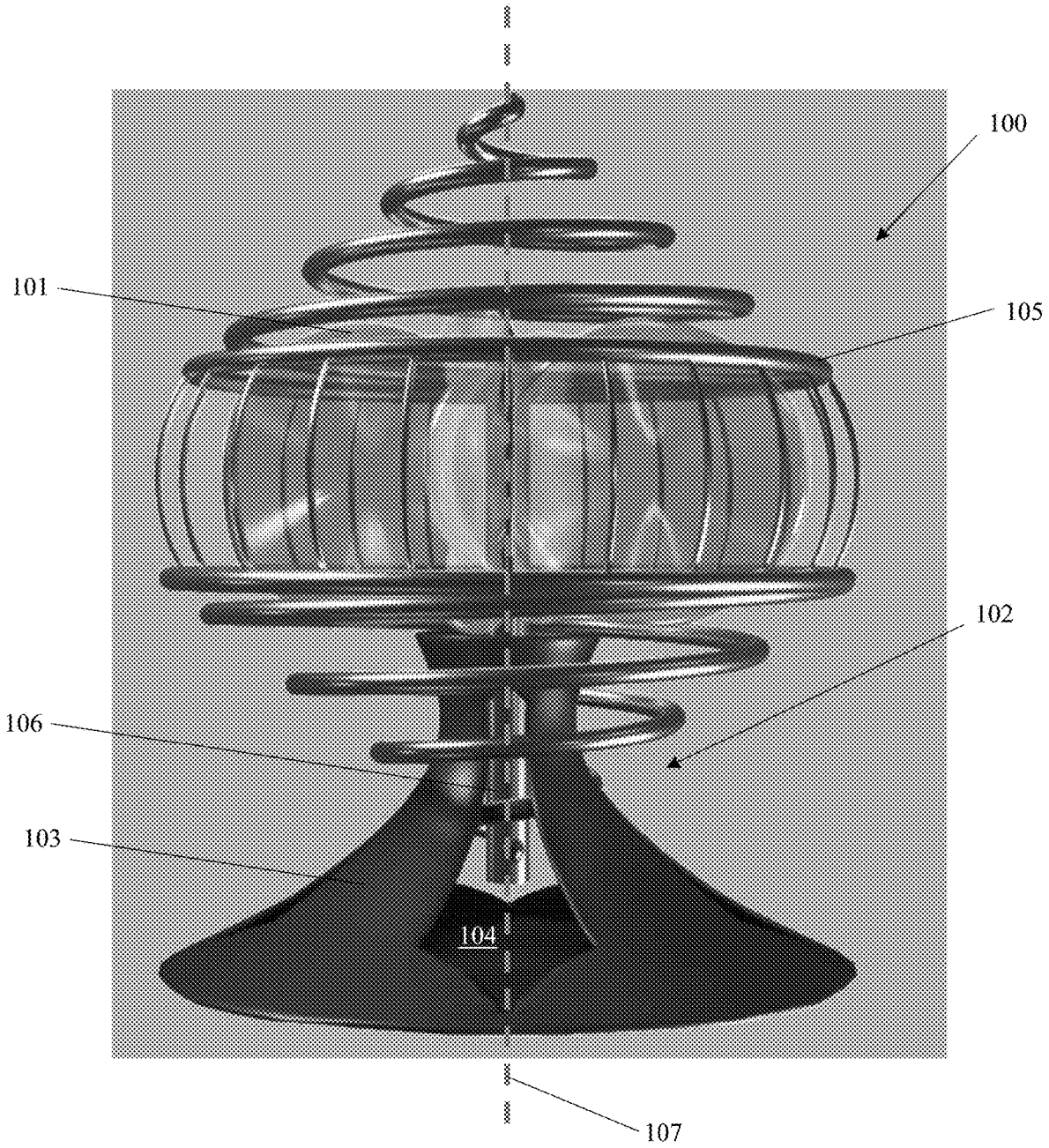
FIG. 1 illustrates the front view of the disclosed radial emission fan, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the front view of the disclosed radial emission fan 100, according to an aspect. The disclosed radial emission fan 100 is configured to ingest axially disposed fluid (e.g., fluid disposed above and below the radial emission blade ("blade") 101), mix the ingested fluid and radially emit said fluid away from the rotational axis ("axis of rotation") 107 of the blade 101 (e.g., tangentially to the rotational axis 107 of the blade 101). In an embodiment, the disclosed fluid may be air, allowing the blade to circulate the air within a surrounding room, if rotated. The herein disclosed embodiment of the blade 101 may have four fins, such as fins 701*a* of FIG. 7, but alternative quantities of fins may be used, as long as device functionality is not hampered. In an embodiment, the disclosed blade 101 may be configured to pull in/ingest axially disposed air evenly from above and below the blade 101 and then evenly push out/disperse said air radially over 360 degrees angle around the blade 101. The disclosed radial emission fan 100, and its equivalents and alternatives described herein (200, 500, 2100, etc.) as well as other structures that utilize the disclosed radial emission blade 101 may each be described as an "apparatus for manipulating a substance." It should be understood that the term "radial emission" refers to the emission of a substance in the full 360 degrees around the rotational axis 107, which can be selectively restricted by an auxiliary structure, such as air shield 1318 of FIG. 13, as disclosed hereinbelow.

The radial emission fan 100 may comprise a fan base 102 associated with a radial emission blade 101. The fan base 102 itself may comprise a fan body 103, an accessory pod slot 104 nested within the fan body 103, a blade rotator (not shown) associated with the fan body 103 and radial emission blade 101, and a blade cage 105 surrounding the radial emission blade 101 and associated with the fan body 103. The blade rotator, which may comprise a blade shaft 106, a clutch system associated with the blade shaft 106, such as magnetic clutch system 612 of FIG. 6, and a motor (not shown) associated with the clutch system, may be configured to engage with the radial emission blade 101 such that the radial emission blade 101 is rotationally engaged with the fan body 103 and thus rotationally engaged with the fan base 102, thus allowing the radial emission blade 101 to rotate about a rotation axis 107. The radial emission blade 101, the fan base 102, and their corresponding elements will be disclosed in greater detail hereinbelow. It should be understood that the blade 101 may be configured to be rotated by the blade shaft 106, whereas the blade shaft 106 is configured to be rotated by a magnetic clutch, such as magnetic clutch 612 of FIG. 6, which itself is attached to an engine (not shown). As such, the engine may be configured to facilitate the rotation of the magnetic clutch, the blade shaft 106 and the blade 101, accordingly.

It should be understood that the radial emission fan and its components may be made of suitably durable materials in order to prevent the radial emission fan from being damaged during storage or use. In an embodiment, the radial emission fan 100 and its various components (e.g., the radial emission blade 101, blade cage 105, fan base 102, blade shaft 106, etc.) may be made of a lightweight metal, such as aluminum, or a durable plastic. Other materials may also be utilized as long as device functionality is not hampered or disrupted. While the radial emission blade 101 and its corresponding apparatus (e.g., the radial emission fan 100) may be discussed more frequently as being utilized for fan-based applications wherein the material being mixed is a fluid, such as air, it should be understood that the same radial emission blade 101 may be utilized with a comparable or different apparatus to allow for the mixing and radial emission of other materials as well. For example, the radial emission blade 101 may be configured to mix liquids (e.g., water, paint, etc.), as well as other substances, such as solid powders, granular mixtures, etc., which will be discussed in greater detail hereinbelow.

Figure 2A:
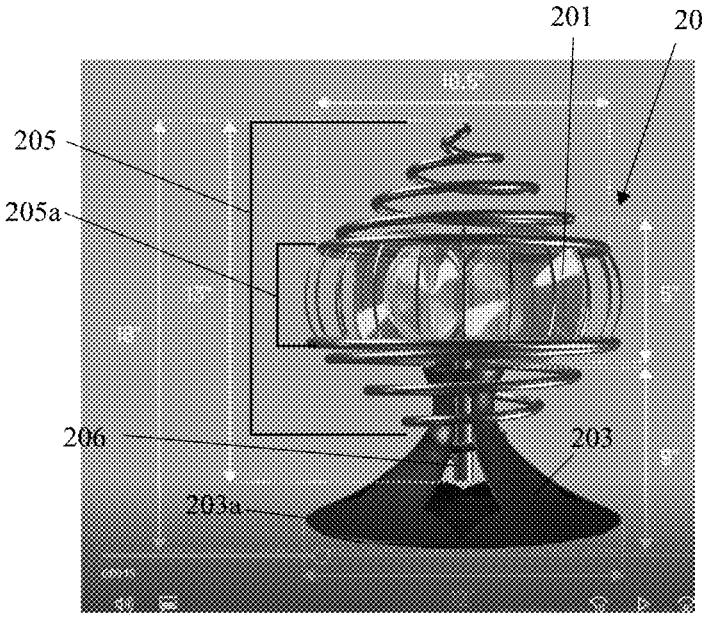
FIGS. 2A-2B illustrate the front and top views of an embodiment of the disclosed radial emission fan, respectively, according to an aspect.
Figure 2B:
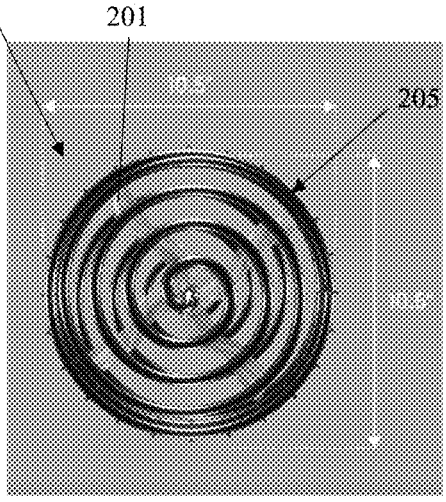

FIGS. 2A-2B illustrate the front and top views of an embodiment of the disclosed radial emission fan 200, respectively, according to an aspect. The disclosed radial emission fan 200 embodiments of FIGS. 2A-2B display potential sizing specifications that may be utilized for a standard consumer model of the disclosed radial emission fan 200. As can be seen in FIG. 2A, the widest portion of the fan base 202 (the central blade cage portion 205*a* of the fan cage 205) may have a diameter of about 10.5". The central blade cage 205*a* may have a height of about 5". It should be understood that the diameter and height of the central blade cage 205*a* may be modified in order to accommodate different sizes of radial emission blades 201, depending on the application of the radial emission fan 200.

The overall height of this embodiment of the radial emission fan 200 may be about 18", wherein the height from the bottom of the blade shaft 206 to the top of the blade cage 205 may be about 13". The fan base 203 itself may have a height of about 9", and a diameter of about 12" at the bottom of the base body 203*a*, its widest portion. It should be understood that these sizing specifications may be modified as needed based on the size of the radial emission blade 201, desired fan height, types of peripherals being utilized, etc.

Figure 3:
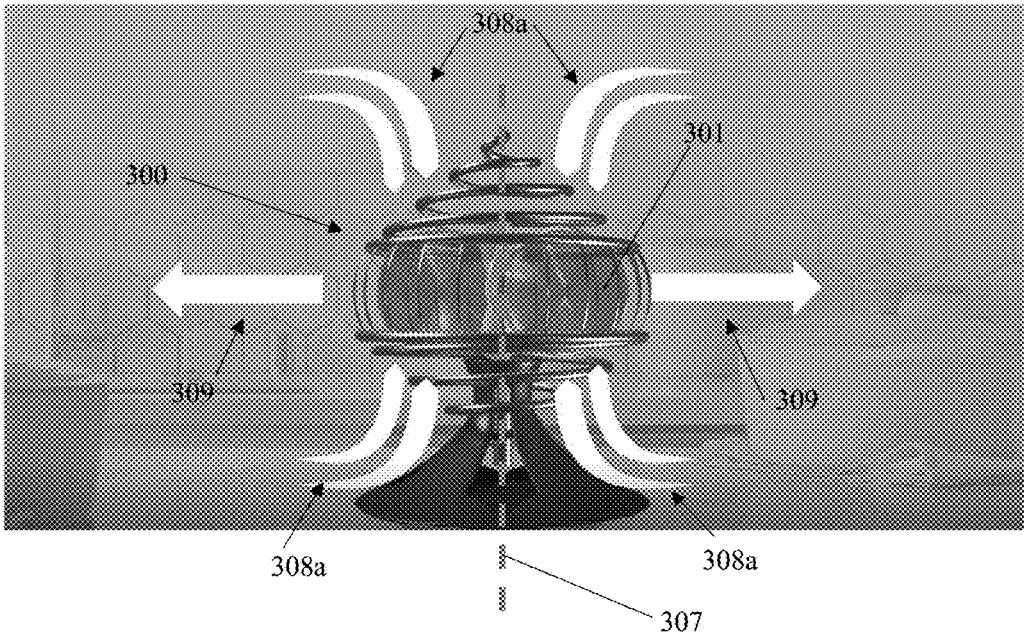
FIG. 3 illustrates the front view of the disclosed radial emission fan and the corresponding air intake flow direction, according to an aspect.

FIG. 3 illustrates the front view of the disclosed radial emission fan 300 and the corresponding air intake and air output directions, according to an aspect. As can be seen in FIG. 3, the disclosed radial emission fan 300 may be configured to ingest air from the axial directions above and below the radial emission blade 301. The axial intake air 308*a* above the radial emission blade and the axial intake air 308*a* below the radial emission blade may be pulled into the radial emission blade 301 as a result of the rotation of said radial emission blade 301 as well as its sinusoidal blade shape, which will be discussed in greater detail hereinbelow. Upon the intake air 308*a* being pulled into and redirected by the radial emission blade 301, said air may be blown radially out away from the axis of rotation 307 as output air 309. The output air 309 may be orthogonal to (e.g., at a 90-degree angle to) the rotational axis, and thus the axially disposed intake air 308*a*, such that individuals surrounding the radial emission fan 300 may feel the output air 309 flowing out toward them, regardless their positioning around the radial emission fan 300.

Figure 4:
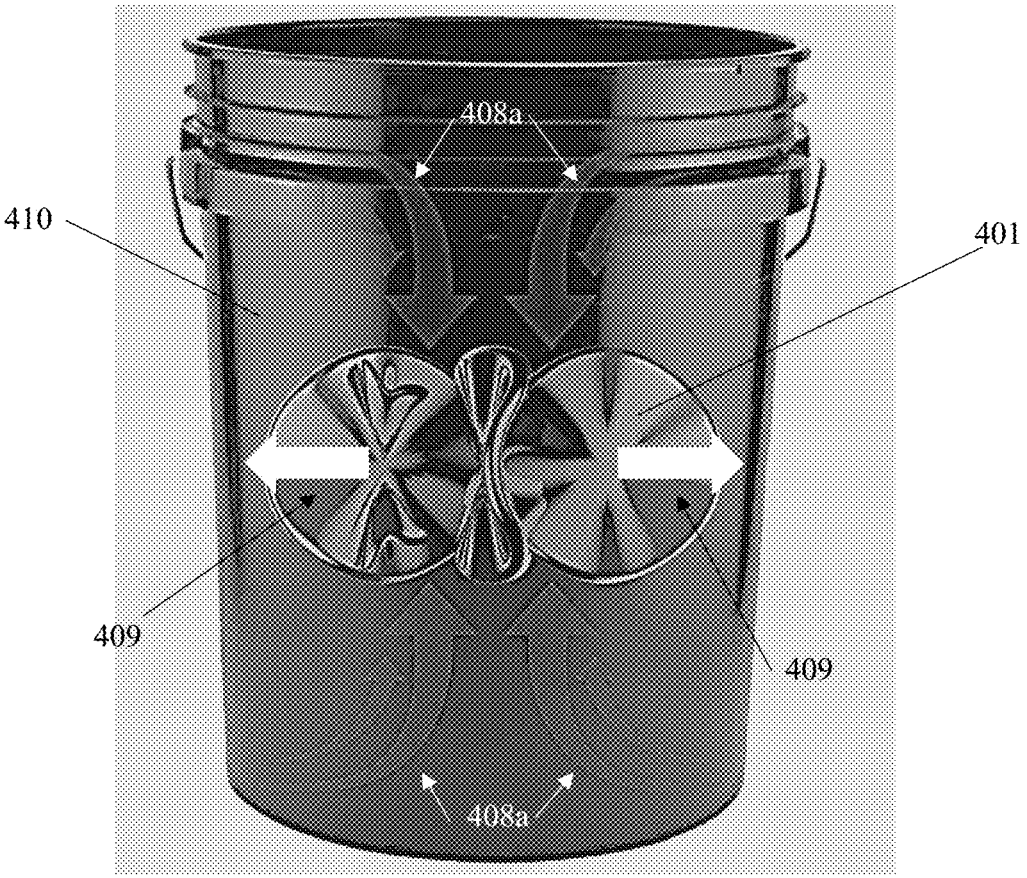
FIG. 4 illustrates the front view of the disclosed radial emission blade being used for fluid mixing operations, according to an aspect.

FIG. 4 illustrates the front view of the disclosed radial emission blade 401 being used for liquid mixing operations, according to an aspect. It should be understood that the disclosed radial emission blade may be used in a variety of fluid manipulation applications and is not limited to being utilized in fans or comparable devices that manipulate air flow. As can be seen in FIG. 4, the disclosed radial emission blade 401 is positioned within a mixer body 410, wherein the radial emission blade 401 is configured to mix a liquid, such as paint, rapidly and efficiently. Similarly to the phenomena described in FIG. 3, the intake fluid 408*a* disposed above the radial emission blade and the intake fluid 408*a* disposed below the radial emission blade may be ingested and directed outward radially as output fluid 409 into the mixer body 410 by the axial rotation of the radial emission blade 401. This in turn allows a fluid within the mixer body 410 to be mixed efficiently.

Figure 5:
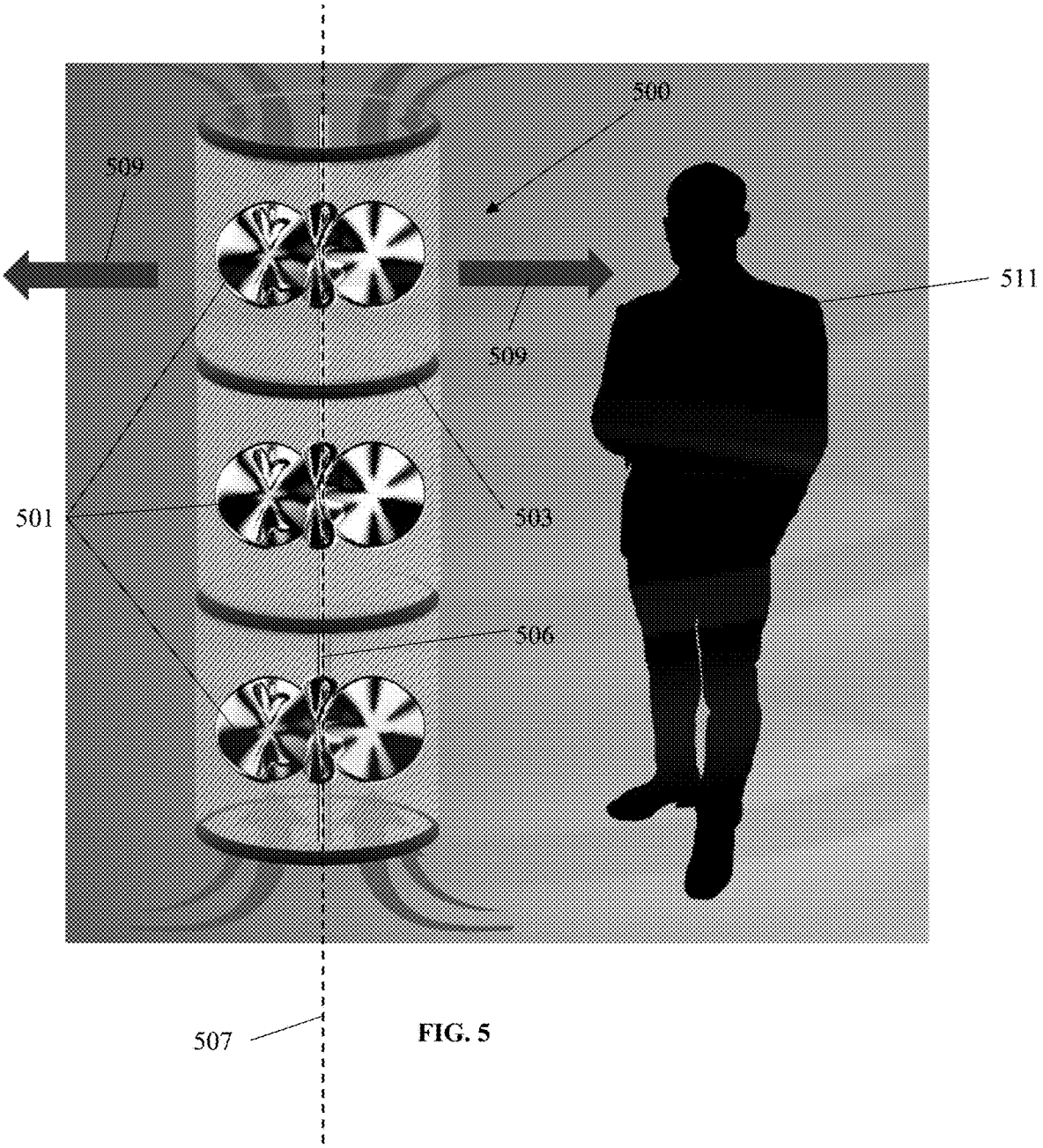
FIG. 5 illustrates the front view of a plurality of the disclosed radial emission blades being used in a singular radial emission fan, according to an aspect.

FIG. 5 illustrates the front view of a plurality of the disclosed radial emission blades being used in a radial emission fan 500, according to an aspect. In order to provide a radial emission fan capable of redirecting air over a larger vertical area, it may be necessary to utilize a plurality of radial emission fans blades 501 within a singular radial emission fan 500. Each radial emission blade 501 may be positioned coaxially aligned with each other on the rotational axis 507, but at different heights along said rotational axis 507, thus allowing the radial emission fan to circulate air at various elevations. Such radial emission fans 500 may allow a user 511 that is within range of the radial emission fan to feel the radially emitted output air 509 regardless of whether they are standing, sitting or lying down. As described above, the radial emission blades 501 may be coaxially aligned with each other on the rotational axis 507, such that the fan body 503 may maintain a simple cylindrical shape. In an embodiment, a radial emission fan 500 may have at least two coaxial blades 501, such that each blade 501 is coaxially aligned on the rotational axis 507. As seen in FIG. 5, the blade shaft 506 may travel coaxially through a corresponding fin hub portion of each blade 501.

The combined rotation of each of the radial emission blades 501 may create a radially travelling "wall" of air that is capable cooling a larger area than air provided by a singular radial emission blade 501 would be capable of doing alone. It should be understood that more or fewer radial emission blades may be used to produce the desired wall of air, based on the needs of the application. Such fans 500 that are configured to circulate larger volumes of air more rapidly may be well suited for applications in larger rooms, warehouses, etc.

It should be noted that the disclosed radial emission blades 501 may also be utilized for the destratification of air within an environment. For example, a warehouse or other structure may have a high roof wherein heat may accumulate, whereas the ground of a structure may remain cold and unheated. As a result of the radial emission blades being configured to pull in axially disposed air and emit it radially, a radial emission fan 500 may be positioned at an intermediate height within said environment, such that it pulls in air from both the ceiling and the ground and mixes them together. This may allow for the heat, moisture and carbon dioxide content, and other aspects of the surrounding air to be homogenized within an environment, which may be desirable in many applications. Furthermore, because the blade 501 may be configured to pull in air from above and below, said blade 501 may be configured to pull air over twice the intake area than if it only received air from above or below. The blade 501 may also be configured to disperse/push air over a wide area, due to its radial, 360 degree emission angle for the expelled air.

In an embodiment, the disclosed blade 501 may be configured to provide suitable conditions for agricultural applications. In said embodiment, the rotation of the blade 501 may be configured to pull carbon dioxide from the ground and disperse it radially to all plants within range. The radial emission/pushing of the air in an outward radial fashion may simulate a gentle breeze, rather than a linear spinning vortex, thus providing conditions suitable for stalk stimulation. Again, by mixing air from above and below, a more normalized uniform air may be provided, with balanced, temperature, humidity, etc.

Figure 6:
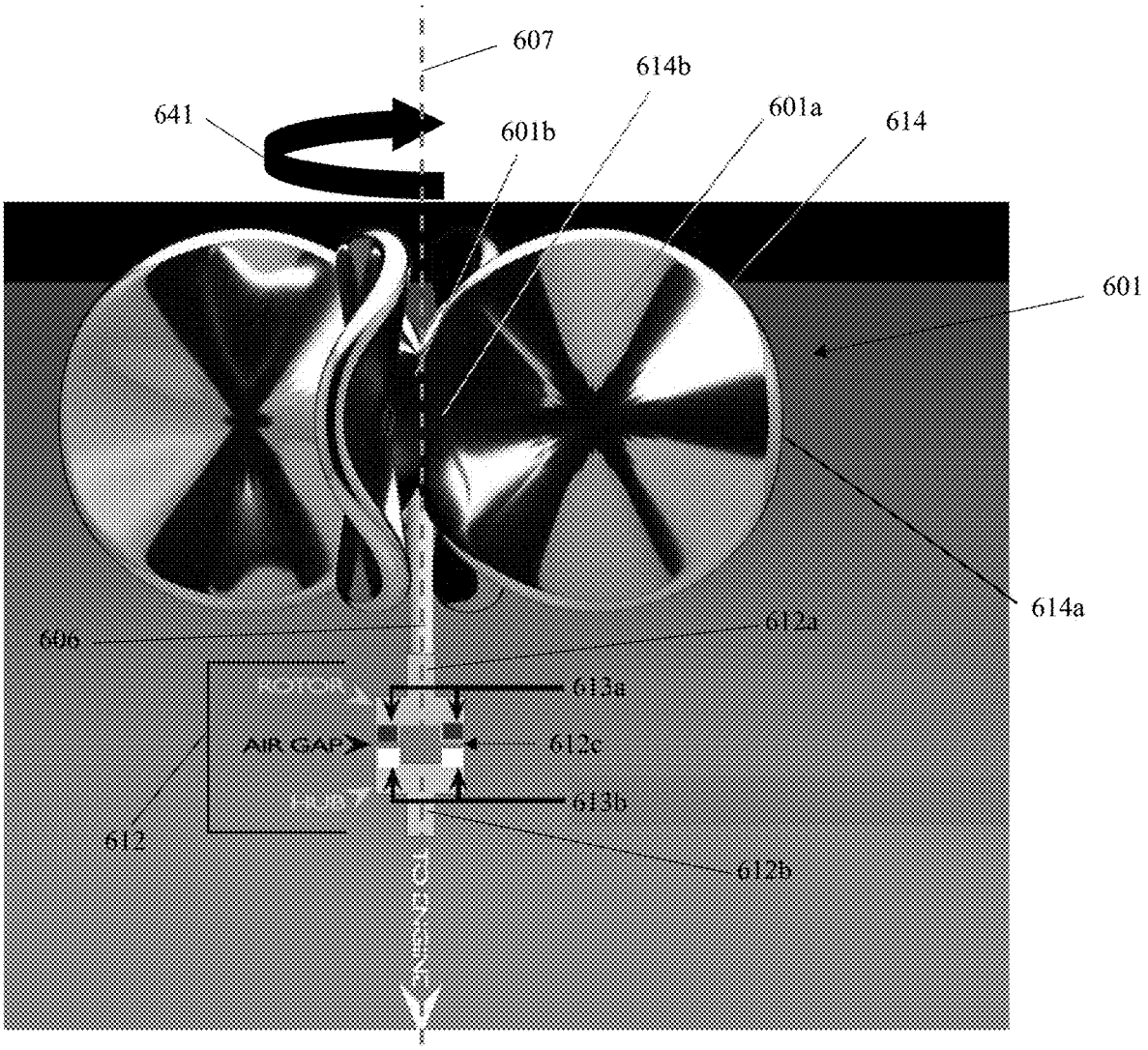
FIG. 6 illustrates the front view of a radial emission blade engaged with a magnetic clutch, according to an aspect.

FIG. 6 illustrates the front view of a radial emission blade 601 engaged with a magnetic clutch 612, according to an aspect. In order to facilitate the rotation of the radial emission blade 601, it may be necessary to engage said blade 601 with a powered element, such as an engine (not shown). The structure depicted in FIG. 6 may be described as part of the blade rotator described in FIG. 1. The mechanism through which this engine or other powered element may engage with and rotate the radial emission blade 601 may vary. In an embodiment, a magnetic clutch 612 may be disposed between and associated with radial emission blade 601 and the powered element. The magnetic clutch may comprise a rotor 612*a* associated with the radial emission blade 601 and a clutch hub 612*b* associated with the powered element, such as an engine.

The magnetic clutch 612 may further comprise a plurality of electric winding (negative) magnetic poles 613*a* associated with the rotor 612 and a plurality of armature (positive) magnetic poles 613*b* associated with the clutch hub 612*b*. The plurality of electric winding (negative) magnetic poles 613*a* associated with the rotor 612*a* may be separated from the corresponding plurality of armature (positive) magnetic poles 613*b* associated with the clutch hub 612*b*. These electric winding magnetic poles 613*a* and armature magnetic poles 613*b* may be separated by an air gap 612*c*, such that the rotor 612*a* and clutch hub 612*b* are configured to not be in direct contact with each other. The rotor 612*a* may be secured to the radial emission blade 601 by the blade shaft 606 described hereinabove in FIG. 1 to ensure proper positioning of the radial emission blade 601. The rotation of the armature magnetic poles 613*b* on the clutch hub 612*b* that is caused by the operation of the engine results in the rotation of the electric winding magnetic poles 613*a* on the rotor 612*a*, thus causing the attached blade shaft 606 and blade 601 to rotate, as a result of the magnetic engagement between each electric winding magnetic pole 613*a* with a corresponding armature magnetic pole 613*b*.

In an embodiment, the engine may be configured to rotate the blade 601 in a clockwise direction 641 to facilitate axial ingestion of air and radial emission of the axially ingested air. For said embodiment, each fin 601*a* may be mounted to a fin hub 601*b* of the blade 601 by a corresponding "valley" portion 614*b* of the outer sinusoidal edge 614 of the fin 601*a*, such that the most radial distal portion of each fin 601*a* is a "hill" portion 614*a* on the outer sinusoidal edge 614. This particular arrangement of the fins 601*a* as described hereinabove with distally disposed "hill" portions 614*a* and clockwise rotational direction 641 about the rotational axis 607 may be a preferred embodiment due to its resultant operation parameters (e.g., intake angle of radially ingested air, height of toroidally emitted air rings, etc.), which will be described in greater detail hereinbelow.

In an embodiment, directional alignment of the fins 601*a* to the horizon (e.g., maximizing the pitch angles of the fins) may improve blade performance for a blade 601 that is rotating closer to the floor/ceiling, or that otherwise has obstructed axial flow into the blade 601. If a blade 601 has fins 601*a* with a neutral pitch angle as seen in FIG. 6 (e.g. a zero degree pitch angle), axial intake of air (or another substance) from above or below the blade 601 is more likely to be obstructed or starved by having a surface that is too close above or below the blade, which may create an undesirable imbalance in intake air from above and below the blade 601. By increasing the pitch angle of each fin 601*a* of the blade, the area over which air is axially ingested may be widened, thus alleviating this issue in embodiments close to an above or below surface. Increasing the pitch angle of each fin 601*a* of a blade 601 may increase the radial diameter over which air is pulled into the blade, while reducing the axial distance from which the air is pulled in, thus creating wider, shorter intake vortexes above and below the blade 601 as pitch angle increases. The pitch angle of each fin will be described in greater detail hereinbelow.

Figure 7A:
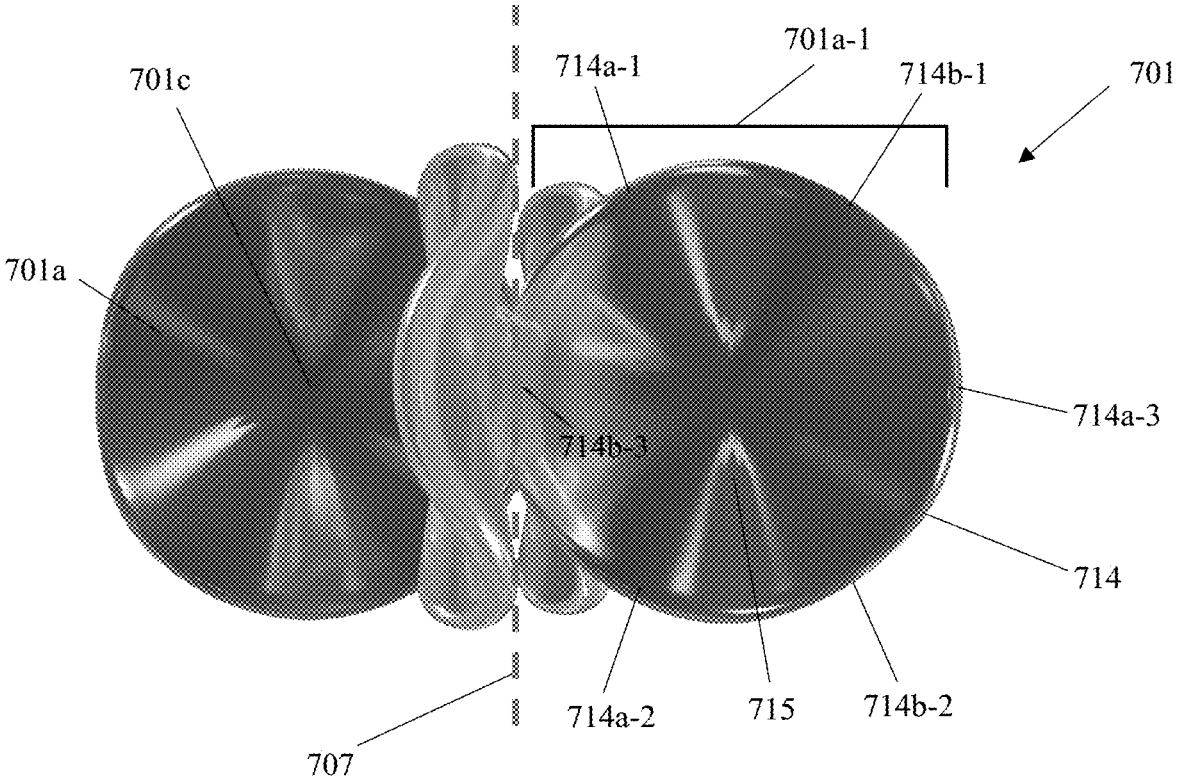
FIGS. 7A-7C illustrate the front, top and perspective views of the disclosed radial emission blade, respectively, according to an aspect.
Figure 7B:
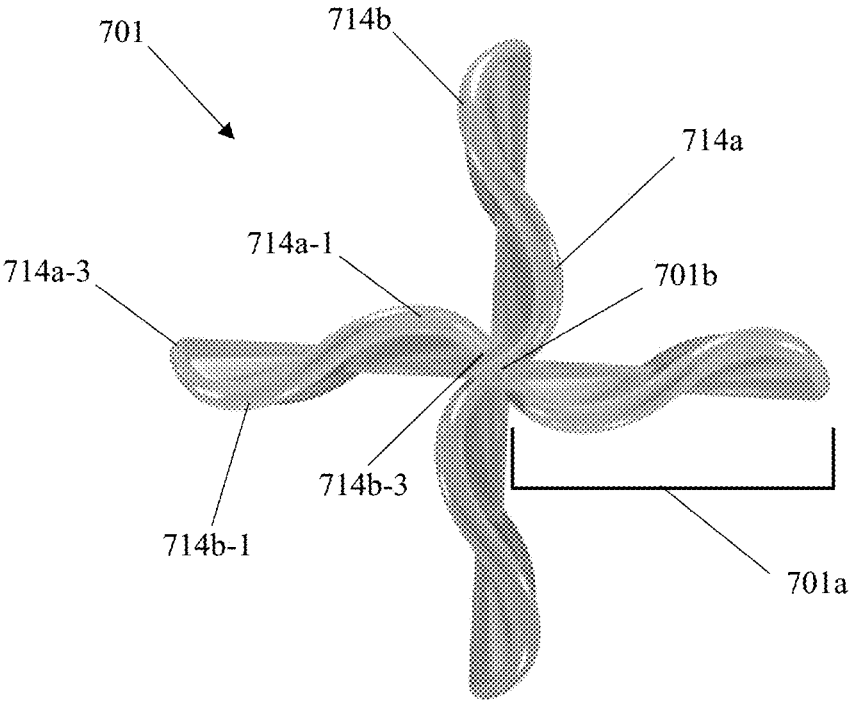
Figure 7C:
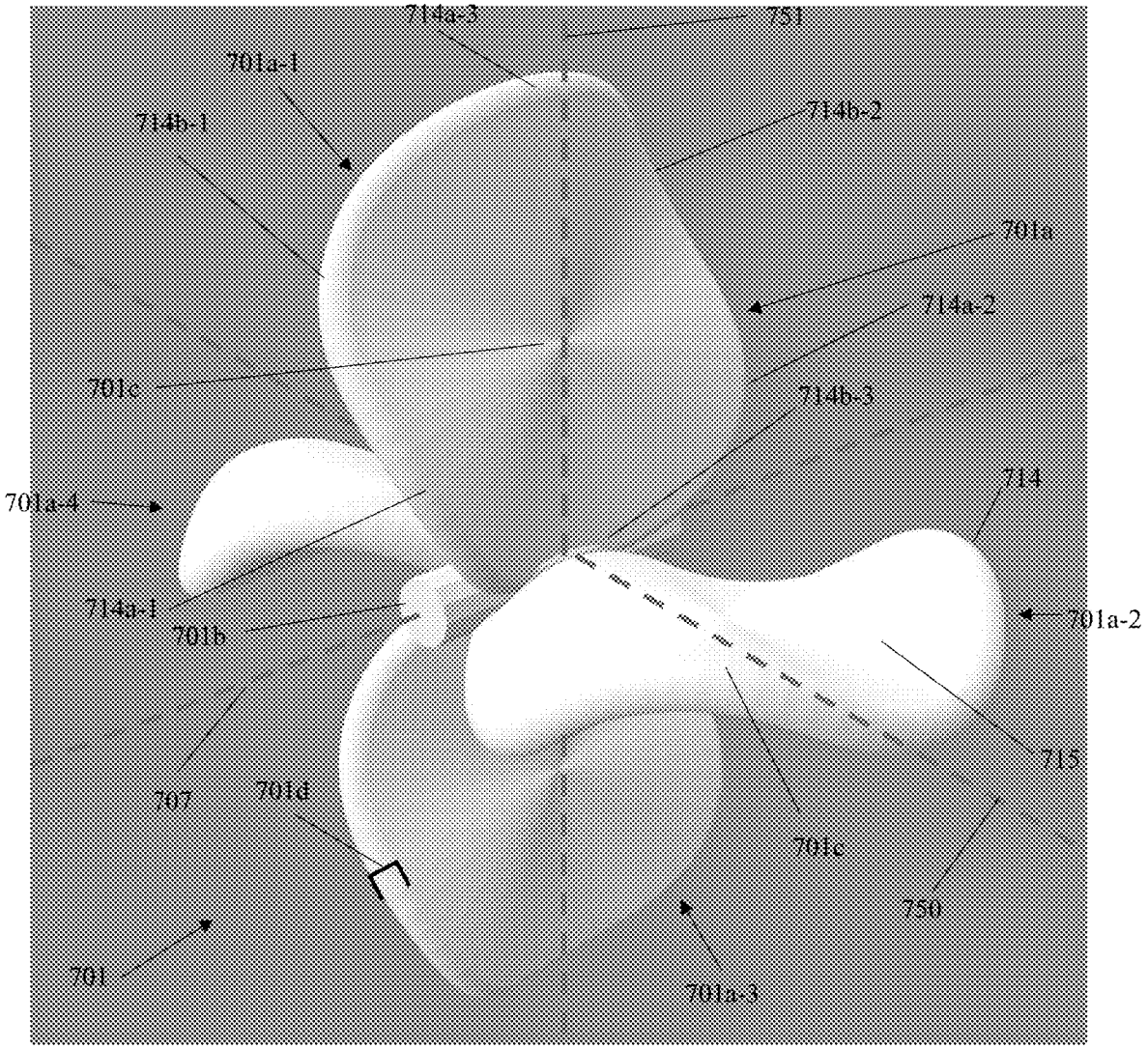

FIG. 7A-7C illustrate the front, top and perspective views of the disclosed radial emission blade 701, respectively, according to an aspect. Each radial emission blade 701 may comprise a fin hub 701*b* and at least one fin 701*a* configured to be associated with the fin hub. The unique structure of each fin 701*a* of the radial emission blade 701 may be configured to allow said blade 701 to pull in air from above and below itself (axially positioned air) and expel or emit said air simultaneously over a 360-degree area around it (radially) wherein the axially positioned intake air is orthogonal to the radially expelled or emitted output air, as described hereinabove. Each fin 701*a* of the radial emission blade 701 may have the same shape, in order to suitably balance the blade 701, and each radial emission blade 701 may have at least one fin 701*a* with a suitable counterbalance (which may be another fin 701*a*) such that balance is established during the rotation of the blade. In an embodiment, a blade 701 may comprise a fin hub associated with at least two fins 701*a*.

Each fin 701*a* may have a sinusoidal form characterized by each fin having a sinusoidal outer edge 714. This sinusoidal edge 714 may surround an inner surface 715. This inner surface 715 may form a continuous, monolithic structure with the sinusoidal outer edge 714, said inner surface 715 having smooth contours that follow the form of the sinusoidally arranged outer edge 714. A center of the fin ("fin center," "center") 701*c* may be disposed at the center of the inner surface 715. As can be seen in FIG. 7A, each fin 701*a*, such as fin 701*a*-1, when viewed from a profile view, may have a circular shape. This circular shape of the fin may be helpful for achieving the necessary axial ingestion and radial exhaust of air through the blade 701. In FIG. 7B, it should be understood that the rotational axis is going into and out of the page through the fin hub 701*b* of the blade 701. It should also be understood that the profile shape of each fin 701*a* may be modified such that it forms an ovoid from its profile view, wherein said change may influence the airflow to favor intake or exhaust, as well as affect the direction and effective area of the intake and exhaust regions.

In an embodiment, each fin 701*a* of a blade 701 may be identical, in order to maintain the balance of the blade 701 during rotation. The thickness of the inner surface 715 may be approximately constant such that it has a uniform thickness throughout each fin 701*a*. This thickness may taper smoothly as it reaches from the outer ends of sinusoidal outer edge 714 to the fin center 701*c*, forming a smooth, rounded edge around each fin 701*a*, or may alternatively form a flat or angled edge by abruptly transitioning between the inner surface 715 and the sinusoidal outer edge 714. In an alternative embodiment, the sinusoidal outer edge 714 may be thicker than the inner surface. It should be understood that the thickness of the outer sinusoidal edge 714 of each fin 701*a*, may influence the resultant drag forces exerted on the blade 701, and thus, different types of edges/edge thicknesses may be utilized within a blade 701 depending on the application of said blade 701.

In order to articulate the structure of each fin 701*a* of the blade 701, the terms "peaks", "hills" or "maximums" may be used to describe the disposition of the sinusoidal outer edge 714 toward one extreme direction, and the terms "troughs", "valleys" and "minimums" may be used to describe the disposition of the sinusoidal outer edge 714 toward the opposite extreme direction. For consistency, the terms "hills" 714*a* and "valleys" 714*b* will be utilized to describe opposing extremes of sinusoidal outer edge's positioning.

As can be seen in FIGS. 7A-7B, each fin 701*a* of the disclosed blade 701 may have a sinusoidal outer edge 714 and an inner surface 715 extending from the sinusoidal edge to the center 701*c* of the fin 701*a*, wherein each fin 701*a* may have three hills 714*a* and three valleys 714*b*. In an embodiment, when following the outer sinusoidal edge 714 of a fin 701*a*, each hill 714*a* may be followed by an adjacent valley 714*b*, and each valley 714*b* may be followed by an adjacent hill, thus forming a reciprocating, continuous pattern of hills and valleys around the outer edge of the fin 701*a* (e.g., a continuous sinusoidal pattern as shown). On each fin 701*a*, each hill 714*a* may be opposite a valley 714*b*. The first hill 714*a*-1 and first valley 714*b*-1 visible from the top view of FIG. 7B may be vertically aligned with the corresponding second hill 714*a*-2 and second valley 714*b*-2, respectively, such that they are not visible from the top view of the of FIG. 7B. In other words, the first hill 714*a*-1 may be opposite the second valley 714*b*-2, and the second hill 714*a*-2 may be opposite the first valley 714*b*-1, whereas the third hill 714*a*-3 is opposite the third valley 714*b*-3. The third hill 714*a*-3 may be disposed on the point of the fin 701*a* that is furthest from the fin hub 701*b*, whereas the third valley 714*b*-3 may be disposed on the point of the fin 701*a* that is closest to the fin hub 701*b*. While this particular embodiment of fin 701*a*, having three hills 714*a* and three valleys 714*b* on each fin 701*a*, is utilized herein, it should be understood that fins having more or fewer hills 714*a* and valleys 714*b* may also be utilized, as long as the sinusoidal structure of the outer edge 715 of each fin 701*a* is preserved.

As can be seen in FIG. 7C, each set of opposite hills and valleys, such as the first hill 714*a*-1 and the second valley 714*b*-2 may meet at the center 701*c*, thus forming the unique shape of each fin 701*a*. The thickness 701*d* of each fin 701*a* may be uniform throughout the inner surface 715, as well as the center 701*c*. The thickness of each fin 701*a* may taper as it reaches the sinusoidal outer edge 714, thus creating a smooth, rounded edge around each fin 701*a*. Each fin 701*a* may be oriented the same way, as seen in FIGS. 7A-7C, in order to maintain the balance of the blade 701. The smoothed edge disclosed above may result in the blade 701 lacking a sharp edge, thus preventing the blade from cutting into the sides or bottom of an attached fan base, mixer body, or whichever structure the blade 701 is installed within, which may help reduce wear and tear on said structure.

As can be seen in FIG. 7C, when placing the disclosed blade 701 within a three-dimensional cartesian coordinate system, each fin may be positioned or otherwise disposed on the X-axis 750 or on the Y-axis 751. Furthermore, the rotational axis 707 may travel along the Z-axis, and thus the rotational axis 707 may simply show the Z-axis in the embodiment of FIG. 7C. As can be seen, the first fin 701*a*-1 and the third fin 701*a*-3 may be disposed on the Y-axis 751 on opposing sides of the fin hub 701*b*. Additionally, the second fin 701*a*-2 and the fourth fin 701*a*-4 may be disposed on the X-axis 750 on opposing sides of the fin hub 701*b*. In short, a blade 701 may have two opposing fins 701*a*-2, 701*a*-4 disposed on the X-axis of the blade 701 and two opposing fins 701*a*-1, 701*a*-3 disposed on a Y-axis of the blade 701, wherein said fins are all associated with the fin hub 701*b*.

Figure 8:
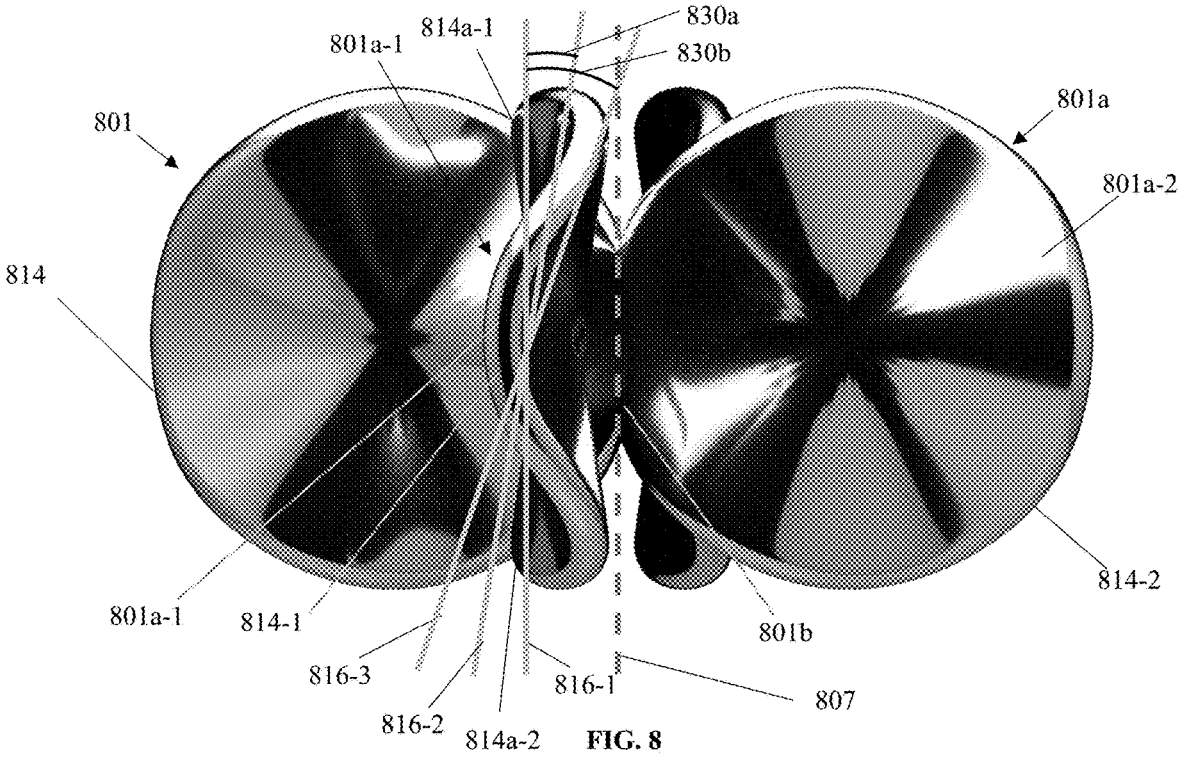
FIG. 8 illustrates the front view of an embodiment of the disclosed radial emission blade being configured to utilize pitched fins, according to an aspect.

FIG. 8 illustrates the front view of an embodiment of the disclosed radial emission blade 801 being configured to utilize pitched fins 801*a*, according to an aspect. While each embodiment of the blade 801 depicted herein may utilize a "neutral pitch angle" (e.g., the pitch angle is about 0 degrees), it is possible, and potentially beneficial in certain applications, to change the pitch angle of each fin 801*a* in order to influence the direction the air is taken from and emitted toward. The term "pitch angle" may be determined by placing a straight pitch line 816-1, 816-2, 816-3 through the cross section of a fin, wherein the pitch line travels through the first hill 814*a*-1 and the second hill 814*a*-2 of a particular fin 801*a*-1. As such, a "neutral pitch angle" would have a pitch line such as pitch line 816-1 wherein the pitch line is parallel with the rotational axis 807.

While a neutral pitch angle, as depicted by pitch line 816-1, may result in the previously described intake of air directly above and below the blade 801 and subsequent axial dispersion of said air, these aspects of other pitch angles may differ. It should be understood that the pitch lines 816-1, 816-2, and 816-3 are to be used to show potential pitch angle embodiments for a first fin 801*a*-1, and are not intended to depict the full range of pitch angles possible for the disclosed fins. As is understood, neutral pitch line 816-1 may have a zero degree pitch angle, and thus may be parallel with the rotational axis 807, such that the fin hub 801*b* is associated with a corresponding portion of the sinusoidal outer edge 814 of the corresponding fin 801*a* at a zero degree angle. For visual simplicity, the pitch angle of the other pitch lines may be measured by comparing the angle of the neutral pitch line 816-1 to the other pitch lines.

Moderate pitch line 816-2 depicts a moderate pitch angle 830*a* for the first fin 801*a*-1 which would influence the function of the blade 801 by moderately increasing the effective area over which the blade 801 intakes and outputs air. Extreme pitch line 816-3 depicts an extreme pitch angle 830*b* for the first fin 801*a*-1 which would influence the function of the blade 801 by significantly increasing the effective area over which the blade 801 intakes and outputs air. The pitch angle 830*a*, 830*b* of each fin of a blade 801 may thusly be modified to reflect the range over which the blade is configured to intake air, in the case of a fan application, or any other fluid in a corresponding application. Furthermore, adjusting the pitch angle of the fins 801*a* may influence the ratio of air pulled into the blade 801 from above the blade 801 to the air pulled into the blade 801 from below the blade, which may also be relevant depending on the application of the fan. In an embodiment, each fin 801*a* of a blade 801 may be pitched such that more air is pulled into the blade 801 from above than below, in order to pull in hotter air from the ceiling to cool and recirculate it accordingly. Again, It should be understood that because the neutral pitch line 816-1 is parallel with the rotational axis 807, that the moderate pitch angle 830*a* may be defined by the angle formed between the neutral pitch line 816-1 and the moderate pitch line 816-2 and extreme pitch angle 830*b* may be defined by the angle formed between the neutral pitch line 816-1 and the extreme pitch line 816-3, as seen in FIG. 8. As is understood, the pitch angle for a fin 801*a* may be varied based upon the corresponding portion of the fin 801*a* that is attached to the fin hub 801*b*, as well as the angle at which said fin 801*a* is attached to the fin hub 801*b*.

Different embodiments of the disclosed blade 801 may allow for the pitch angle of their corresponding fins 801*a* to be adjusted through various mechanisms. In an embodiment, each fin 801*a* of a blade 801 may be removable, such that the pitch angles of each fin 801*a* of a blade 801 may be modified by removing a first set of fins 801*a* having a first pitch angle from the blade 801 (e.g., removing each fin 801*a* from the fin hub) and replacing them with a second set of fins having a second pitch angle. In an alternative embodiment, the pitch angle of each fin 801*a* of the blade 801 may be adjustable through a suitable adjustment mechanism, such a knob or dial, which is configured to be rotated to manually manipulate to pitch angle of each fin 801*a* of the blade 801. This knob or dial may be positioned somewhere convenient on the blade 801 or fan base, such that a user may easily access the said knob to adjust the pitch angle of the fins 801*a* as needed.

While the hereinabove disclosed blade embodiments may each have a corresponding fin attached to the fin hub by valley portion on the sinusoidal outer edge, such as the third valley 714*b*-3 of sinusoidal edge 714 in FIG. 7A, it should be understood that the pitch of a corresponding fin may also be influenced based upon which portion of the fin attaches to the fin hub (e.g., the pitch angle of a fin may be influenced by the point along the sinusoidal outer edge that is secured to the fin hub). For example, the pitch angle of a fin that is attached to the fin hub by a hill (or a portion between a valley and a hill) may have a different pitch angle than a fin that is attached to the fin hub by a valley. Additional blade embodiments having fins with modified pitch angles will be discussed in greater detail hereinbelow.

As can be seen in FIG. 8, each sinusoidal fin 801*a* may be associated with the fin hub 801*b* by a corresponding portion of the sinusoidal outer edge 814 of said fin 801*a*. Furthermore, each fin 801*a* when viewed from a front view may appear such that a projection of the outermost points of said fin 801 is circular, as shown by the sinusoidal outer edge 814-2 of second fin 801*a*-2 from FIG. 8. In other words, from a front view of a fin 801*a*-2, a corresponding sinusoidal outer edge 814-2 may appear to be circular. In contrast, when a corresponding first fin 801*a*-1 is viewed from a side view, the sinusoidal nature of the corresponding sinusoidal outer edge 814-1 of the first fin 801*a*-1 may be clearly seen, as shown by sinusoidal outer edge 814-1 of the first fin 801*a*-1 of FIG. 8.

Figure 9:
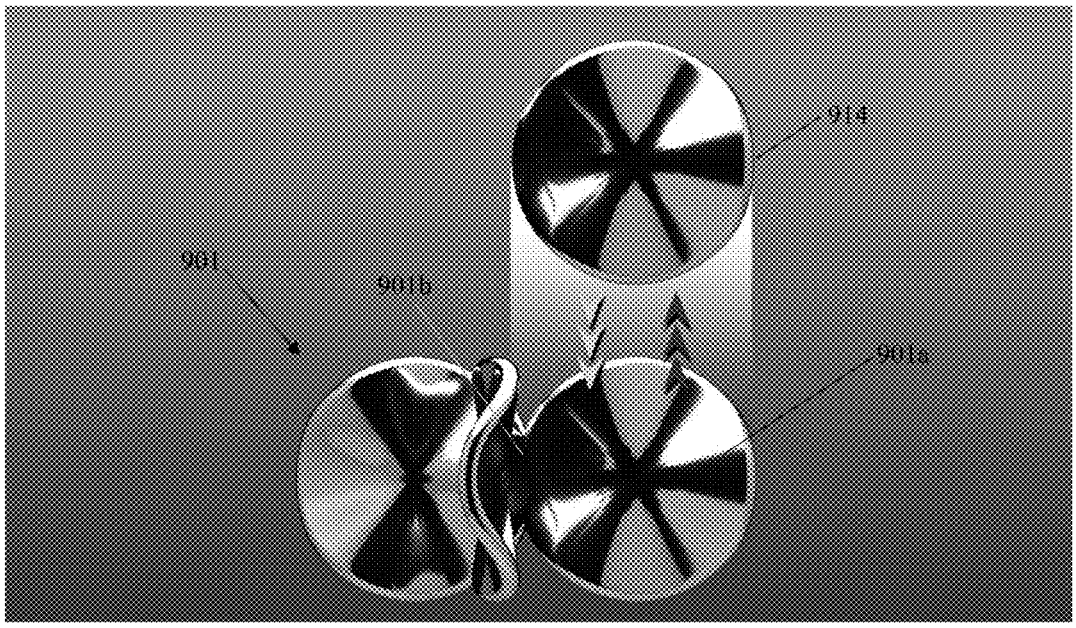
FIG. 9 illustrates the front view of an embodiment of the disclosed radial emission blade having removable fins, according to an aspect.

FIG. 9 illustrates the front view of an embodiment of the disclosed radial emission blade 901 having removable fins 901*a*, according to an aspect. In order to facilitate easy maintenance, replacement or adjustment of operating parameters (e.g., pitch angle of each fin) of a radial emission blade 901, each fin 901*a* may be configured to be removable from the fin hub 901*b*. These removable fins 901*a* may be replaced or removed based on the needs of the user and each fin 901*a* may be joined to the fin hub 901*b* using a connective structure (not shown) that is easy to manipulate, but secure, such as a snap, clip, screw, hook-loop fastener, glue, etc. As such, the fin hub 901*b* may be removably associated with the corresponding portion of the sinusoidal outer edge 914 of the fin 901.

Each fin may be installed (or removed) by moving the fin axially toward (or away from) the fin hub to engage (or disengage) said fin 901*a* with the suitable structure on the fin hub 901*b*, as seen in FIG. 9. In alternative embodiments, the fins 901*a* and fin hub 901*b* may form a unified, monolithic structure, wherein the fins 901*a* are not removable.

Figure 10:
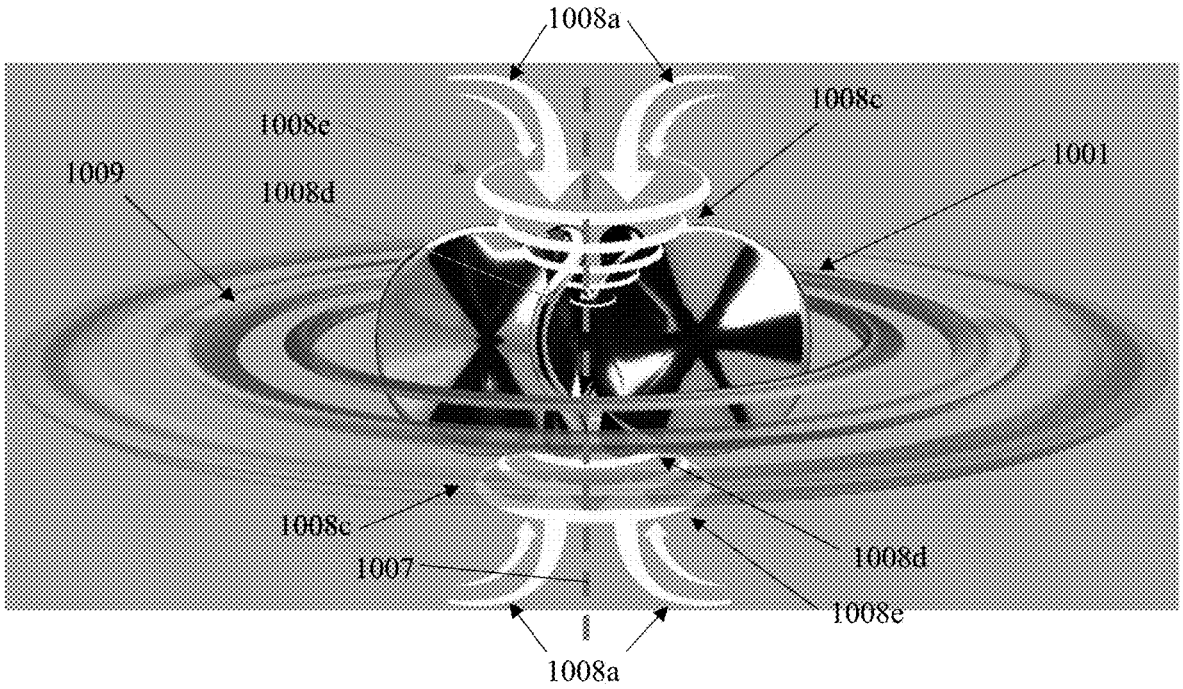
FIG. 10 illustrates the front perspective view of the disclosed radial emission blade being rotated, according to an aspect.

FIG. 10 illustrates the front perspective view of the disclosed radial emission blade 1001 being rotated, according to an aspect. As depicted in FIG. 3, rotation of the disclosed radial emission blade 1001 results in air being pulled toward said blade 1001 from above and below 1008*a*, colliding and mixing with the blade 1001 and being distributed radially away from the rotational axis 1007, as depicted by radial outgoing air 1009. It is important to note that the radial emission blade 1001 should be made of a suitable material that is lightweight, durable and remains stable when rotated (e.g., does not deform significantly). As such, lightweight metals, such as aluminum, and durable plastics may be used for the radial emission blade 1001. Both the axially disposed air 1008*a* pulled in from above and the axially disposed air 1008*a* pulled in from below may form two opposing vortexes of intake air 1008*c* that are pulled into the radial emission blade 1001 for mixing and subsequent pushing out of the air 360 degrees around and away from the rotational axis 1007. The complementary, opposing vortexes 1008*c* may collide at the blade 1001 disposed between them, thus facilitating faster and more efficient mixing of the two vortexes 1008*c*. In an embodiment, these opposing vortexes of intake air 1008*c* may each have a conical shape, wherein the narrower portion 1008*d* of each vortex 1008*c* is disposed closer to the blade 1001 than the wider portion 1008*e* of each vortex 1008*c*. As is understood, both of the opposing vortexes 1008*c* of intake air may be coaxially aligned with the rotational axis 1007.

Figure 11:
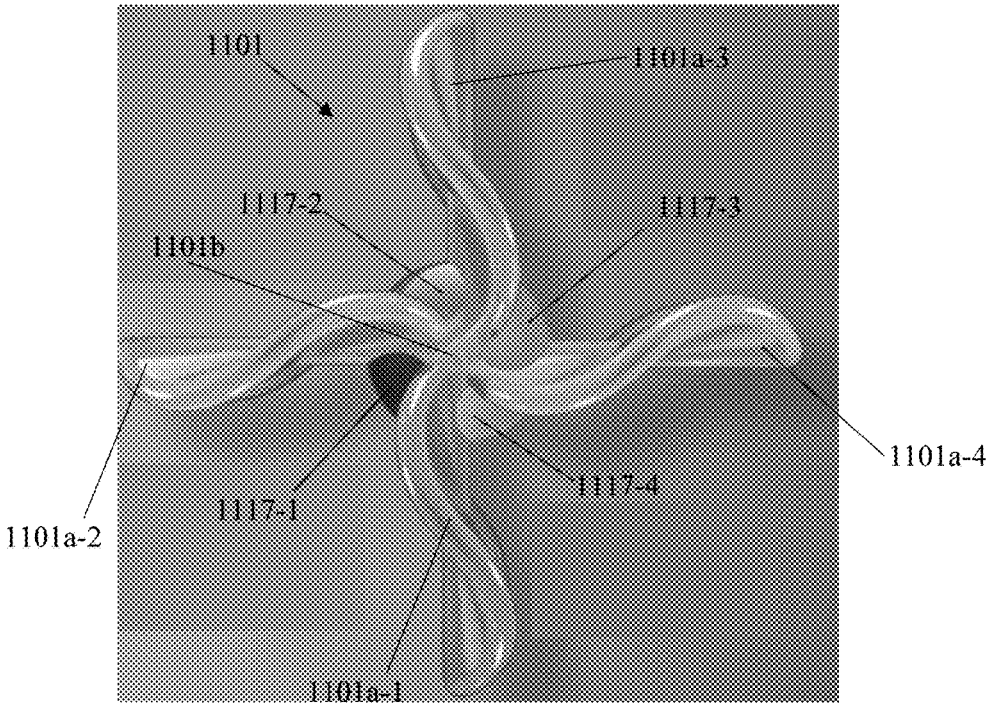
FIG. 11 illustrates the top view of an embodiment of the disclosed radial emission blade having a plurality of dispersion packs, according to an aspect.

FIG. 11 illustrates the top view of an embodiment of the disclosed radial emission blade 1101 having a plurality of dispersion packs, according to an aspect. Dispersion packs 1117-1, 1171-2, 1117-3, 1117-4 may be structures capable of emitting a desired scent for a prolonged time. These dispersion packs may be configured to efficiently distribute said scent into a space or room through the radial distribution of output air from the blade 1101 as described hereinabove. Each dispersion pack may be associated with two adjacent fins, and/or the corresponding fin hub portion disposed between them, such that the four dispersion packs together form a roughly spherical shape upon their installation with the fin hub 1101*b*, said fin hub 1101*b* being positioned at the center of said spherical shape, as seen in FIG. 11.

As seen in the disclosed embodiment of FIG. 11, the first dispersion pack 1117-1 may be associated with and disposed between the first fin 1101*a*-1 and the second fin 1101*a*-2, the second dispersion pack 1117-2 may be associated with and disposed between the second fin 1101*a*-2 and the third fin 1101*a*-3, the third dispersion pack 1117-3 may be associated with and disposed between the third fin 1101*a*-3 and the fourth fin 1101*a*-4, and finally the fourth dispersion pack 1117-4 may be associated with and disposed between the fourth fin 1101*a*-4 and the first fin 1101*a*-1. As disclosed above, each dispersion pack may also/alternatively be associated with a corresponding portion of the fin hub 1101*b* to ensure the dispersion packs remain securely attached.

In order to maintain the balance of the blade 1101 during rotation, it may be necessary for each dispersion pack 1117-1, 1171-2, 1117-3, 1117-4 to be roughly the same size, shape and weight. Additionally, it may be important that the specific materials used for each dispersion pack are used or depleted at the same rate, such that potential the weight imbalance of the blade 1101 does not occur during use, which may negatively influence rotational performance.

While each embodiment of the blade 1101 disclosed herein may have four fins, 1101*a*-1, 1101*a*-2, 1101*a*-3 and 1101*a*-4, as seen in FIG. 11 and described above, it should be understood that the quantity of fins per blade 1101 may be varied as long as the balance of the blade 1101 is maintained during rotation. In order to maintain the balance of the blade 1101, a minimum of a singular fin, such as first fin 1101*a*-1, may be positioned opposite a counterweight (not shown). This single fin alternative may be the quietest of the potential embodiments, as the result of having no cavitation occurring from a first fin hitting the wake of a second, adjacent fin. Alternatively, the disclosed blade 1101 may utilize a greater plurality of fins (e.g., two, three, four, five, etc.) while still being arranged to be balanced during rotation, as will be discussed in greater detail hereinbelow.

Figure 12:
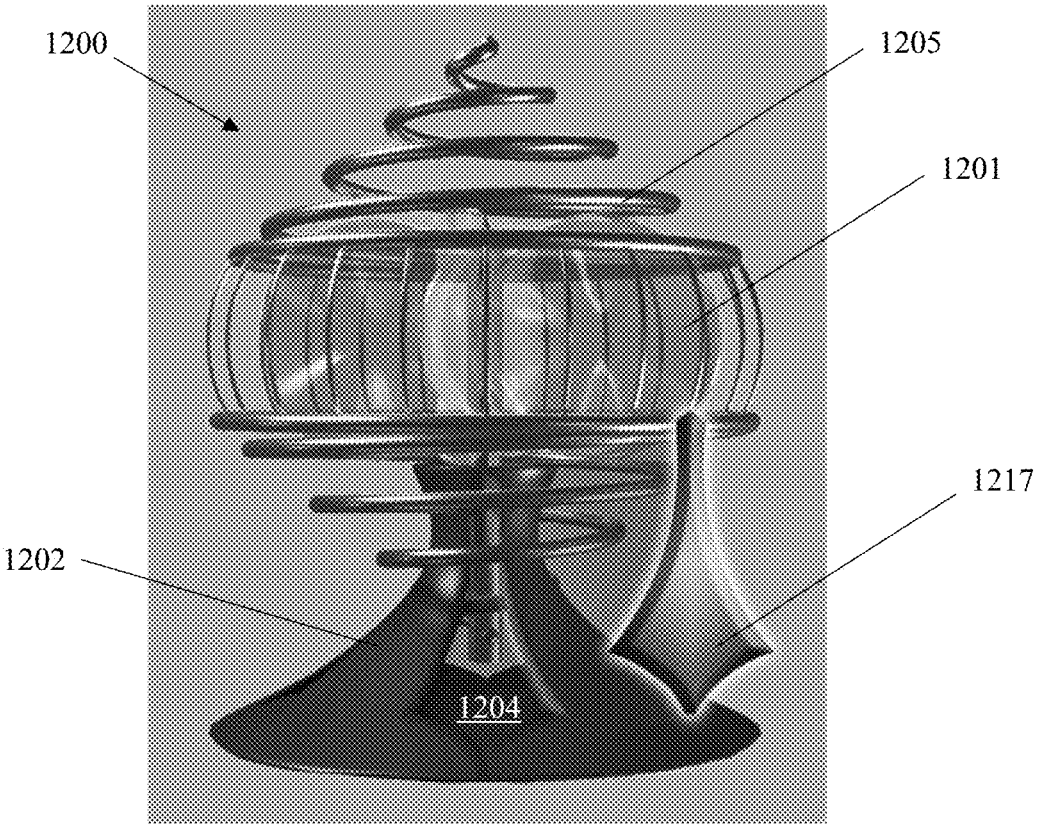
FIG. 12 illustrates the front perspective view of an embodiment of the disclosed radial emission fan engaging with an accessory pod, according to an aspect.

FIG. 12 illustrates the front perspective view of an embodiment of the disclosed radial emission fan 1200 engaging with an accessory pod 1217, according to an aspect. In order to allow for the utilization of a suitable accessory pod 1217 alongside the disclosed radial emission blade 1201 within the radial emission fan 1200, an accessory pod slot 1204 configured to house an accessory pod 1217 may be nested within the fan body 1203. A variety of different structures may be nested within the disclosed accessory pod slot 1204, as will be disclosed hereinbelow.

Similarly to the prior disclosed dispersion packs 1117-1, 1171-2, 1117-3, 1117-4 of FIG. 11, the accessory pod 1217 may be scented, wherein said scented accessory pod 1217 may be positioned within the accessory pod slot 1204. As a result of axially positioned air being pulled toward the blade 1201 from above and below during blade rotation, the scent of said scented accessory pod 1217 disposed below the blade 1201 may be pulled into the blade 1201 and distributed radially. Such a scented accessory pod 1217 may utilize citronella-based substances, which may be used in outdoor applications such as bug/mosquito repellence, and/or other scented materials, which may be used in indoor applications. It is also possible for said accessory pod 1217 to be scented while simultaneously performing other functions, several of which will be described below.

In an embodiment, the accessory pod 1217 may have electronic elements, such as a light and/or a speaker. Lights, such as color changing LEDS, may help illuminate the surrounding area and the blade 1201 while achieving a desired visual aesthetic. The lights may be pointed upward towards the blade 1201 in order to achieve a unique visual appearance as the blade 1201 rotates. For example, the rotation of the blade 1201 may result in light emitted from the accessory pod 1217 being reflected/directed in a variety of different directions during rotation, which may be desirable for certain applications. In an embodiment, each fin of the blade 1201 may be provided in a particular color. In some embodiments, each fin of a blade 1201 may be the same color (e.g., red, green, blue, silver, gold, etc.) while in alternative embodiments each fin of a blade 1201 may be provided in a different color. In either embodiment, the fins of the blade 1201 may be configured to reflect light emitted from the accessory pod, potentially influencing the color of the light reflected out into the environment based on its own color. In an alternative embodiment, the fins of the blade 1201 or the entire blade 1201 may be made of a translucent material, such that lights disposed within the blade 1201 or near the blade 1201 (e.g. in the accessory pod slot 1204) may shine through the blade 1201 as it rotates to produce a unique lighting effect. Any speakers on the accessory pod 1217 may be fitted with a suitable Bluetooth receiver/transceiver in order to allow a user to interface easily with the speaker and play selected audio of their choosing using a remote device, such as smart device, as will be discussed in greater detail hereinbelow.

Each electronic element of an accessory pod 1217 may be powered by a rechargeable battery (not shown) stored within the accessory pod 1217, thus making the accessory pod portable. This rechargeable battery may charge from its connection to the fan base 1203, wherein the fan base 1203 itself powers the fan (e.g., its motor or other rotational means) by virtue of a main battery, a connection to a wall outlet, or another suitable powering method. If the accessory pod 1217 is powered by a separable power source, such as a rechargeable battery, it may be possible to remove the accessory pod 1217 from the fan base 1203 while still having it produce sound/light, to ensure suitable positioning of sound/light emitting accessory pod. In an embodiment, accessory pods 1217 having speakers may be sold in pairs or larger pluralities, allowing the speakers to be positioned to supply users with an improved audio experience, having a stereo and/or surround sound set-up.

The accessory pod 1217 may also act as a decorative element, helping the fan 1200 to achieve a desired look or style. One example decorative element may be a chrome metallics based structure. It should be understood that the accessory pod 1217 may perform one or more, or none, of the functions disclosed herein, as necessitated by the application. In an embodiment, the accessory pod 1217 may be configured to be scented, have color changing LED lights, and a Bluetooth speaker configured to play music from a wirelessly connected mobile device. Furthermore, the accessory pod 1217 may be configured to interact with an application, such as a mobile app, through the utilization of a Bluetooth connection, allowing a user to manipulate the speakers, lights, etc. on an accessory pod straight from a controller or Bluetooth enabled device, such as a smartphone.

It should be understood that the radial emission fan 1200 and its various elements may also be decorated to achieve a desired visual appearance. Designs ranging from camouflage to vibrant advertisements may surround the fan blade 1201 and fan base 1202 in order to suit the application of the fan 1200, as long as they do not negatively impact fan performance. Furthermore, the accessory pod 1217 may also be decorated in order to match this design aesthetic, thus forming a fan 1200 having a unified design aesthetic. The blade cage 1205 may also appear to have a decorative appearance, as long as its ability to protect blade 1201 is retained.

Figure 13:
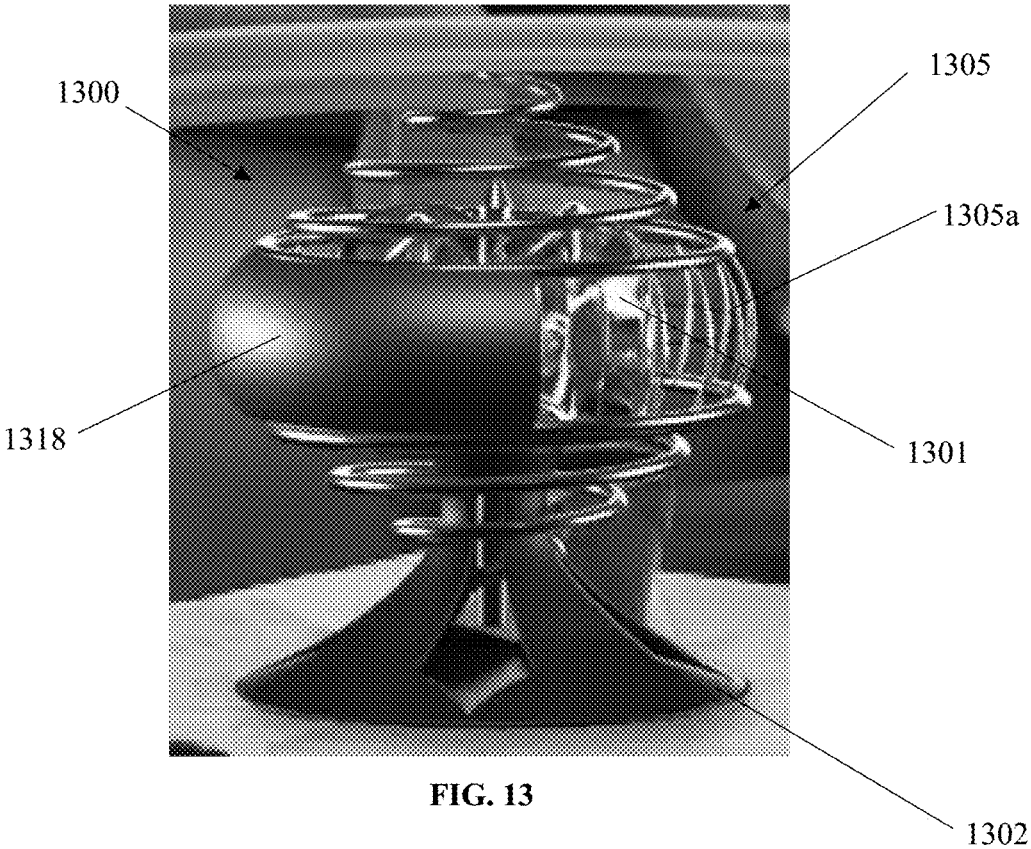
FIG. 13 illustrates the front perspective view of an embodiment of the disclosed radial emission fan having an air shield, according to an aspect.

FIG. 13 illustrates the front perspective view of an embodiment of the disclosed radial emission fan 1300 having an air shield 1318, according to an aspect. While the radial emission blade 1301 may be configured to radially distribute air in a full 360-degree radius around the radial emission fan 1300 in many embodiments, certain applications may find it preferable or required to limit the radius of emitted air to less than the full 360 degrees. In an alternative embodiment, an air shield 1318 may be secured to the blade cage 1305 in order to restrict the range over which radial emitted air is distributed. More specifically, the air shield 1318 may be secured to the central blade cage **1305*a* for suitable positioning of the air shield 1318 to prevent the proliferation of blown air, or other fluids or substances, in certain direction. In other words, an air shield 1318 may be associated with the base 1302** and may be configured to reduce the 360 degree angle at which the substance is pushed out of the radial emission fan.

In an embodiment, the air shield 1318 may be configured to surround a 90-degree radial portion of the central blade cage **1305*a*, as shown in FIG. 13, such that the radially emitted air is partially blocked by the air shield 1318 and thus effectively redirected toward the remaining radial 270 degrees of the fan cage that are not blocked by the air shield 1318. It should be understood that the air shield 1318 may be configured to be easily removable from the blade cage 1305 and may be made of materials comparable to that of the blade cage 1305. Furthermore, the air shield 1318 may be provided in different sizes, such that the radial portion of the central blade cage 1305*a* that is covered may be varied based on the needs of the user. In an embodiment, the air shield 1318 may cover a 180-degree portion of the central blade cage 1305***a*, thus effectively redirecting radial emitted air toward the unobstructed, uncovered half (e.g., the opposing 180-degree portion) of the radial emission fan 1300. An air shield 1318 may be provided in modular sections to allow the user to selectively use one or more of said modular sections to cover as much or as little of the radial emission fan 1300 as is needed.

Figure 14:
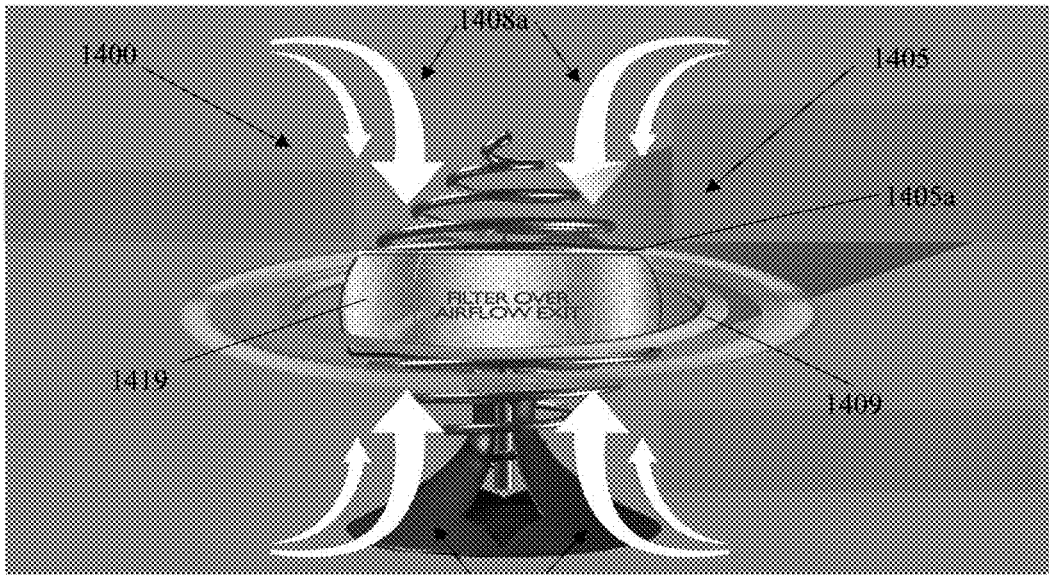
FIG. 14 illustrates the front perspective view of a radial emission fan having a radial exhaust air filter, according to an aspect.

FIG. 14 illustrates the front perspective view of a radial emission fan 1400 having a radial exhaust air filter 1419, according to an aspect. In addition to radially distributing air in order to circulate air within and cool an area, distribute a scent, etc., the disclosed radial emission fan may be provided with a radial exhaust air filter 1419 such that air is taken into the fan 1400 axially and filtered as it is distributed radially. Similarly to the prior disclosed air shield 1318 of FIG. 13, the disclosed radial exhaust air filter 1419 may be configured to engage with the central blade cage 1405*a* of the of the blade cage 1405. As such, axial air intake 1408*a*, is suitably filtered by the radial exhaust air filter 1419 as it is radially emitted as output air 1409.

The positioning of the radial exhaust air filter 1419 over the central blade cage 1405*a* is such that air that would normally pass through the central blade cage 1405*a* (e.g., the radially emitted/distributed air 1409) is passed through the radial exhaust air filter 1419, thus filtering the air as it escapes the central blade cage 1405*a* radially. The radial exhaust air filter 1419 may be configured to filter any material or particulate known in the field (e.g., dust, allergens, smoke, etc.) out of the radially emitted air. The radial exhaust air filter 1419 may also be configured to be removable, such that a user only installs the radial exhaust air filter when it necessary or desirable to do so. It should be understood that alternatively positioned air filters, such as axial intake air filters 1832 of FIG. 18, may also be utilized within a radial emission fan, or other blade assembly requiring filtration of incoming materials.

Figure 15:
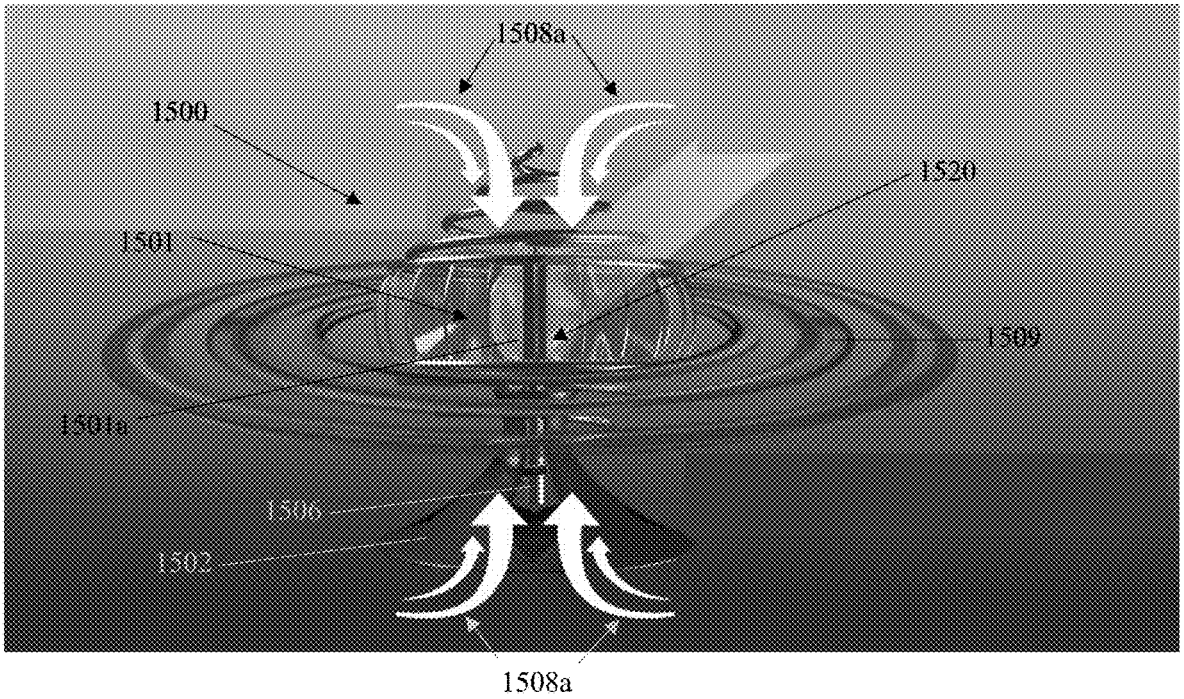
FIG. 15 illustrates the front perspective view of a radial emission fan having a heater, according to an aspect

FIG. 15 illustrates the front perspective view of a radial emission fan 1500 having a heater 1520, according to an aspect. In order to allow the radial emission fan 1500 to effectively heat a space, said radial emission fan 1500 may be provided with a heater, 1520 as seen in FIG. 15. The heater 1520 may be positioned adjacent to the fin hub (not shown) of the radial emission blade 1501 in order to allow it to provide heat to the radially emitted air without itself being rotated by blade rotation.

In an embodiment, the heater 1520 may be positioned coaxially below the radial emission blade 1501 and within the fan base 1502, such that heated, axially positioned air 1508*a* positioned below the radial emission blade 1501 may be pulled into the blade 1501 alongside axially positioned air 1508*a* positioned above the radial emission fan base 1501, to be mixed, redirected and emitted in a radial direction as radially emitted, heated air 1509. In an alternative embodiment, the heater 1520 may be coaxially aligned with the blade 1501 and disposed at the same vertical height as the fins of the blade (e.g., the heater 1520 may be disposed between the fins 1501*a* of the blade 1501, on or within the fin hub, such as fin hub 701*b* of FIG. 7A-7B), such that the heater 1520 is configured to heat incoming air from both above and below the blade in an even distribution. It should be understood that the various embodiments and examples of the radial emission fans may have their features combined. In an alternative embodiment, a radial emission fan may be provided with an air shield 1318 as seen in FIG. 13, an air filter 1419 as seen in FIG. 14 and a heater 1520 as seen in FIG. 15, in order to provide a radial emission fan having a desired combination of functionalities. It should be understood that the heating element 1520 may be replaced with a cooling element (not shown), in order to suitably distribute cold air in a radial fashion as described herein.

The disclosed radial emission blade 1501 may be used within a structure such as the radial emission fan 1500 in order to provide consumers with a versatile, radial emission fan capable of emitting air in a 360-degree radius around it. The structure of the radial emission blade 1501 may be configured such that air, another fluid, or another substance is taken in at the same rate from above and below the blade 1501, thus cancelling the axial intake flow and preventing blowback at high rotational speeds. Certain devices may utilize a plurality of stacked blades 1501 to produce a radially moving wall of wind, as described in FIG. 5, to cool/heat a large area, such as an industrial work site, quickly and efficiently. The axial ingestion, subsequent mixing and following radial distribution of air helps keep the air in a room well mixed, thus preventing "stale air" from forming and being circulated. Additional structures, such as misting jets (not shown), may be associated with the fan base 1502 in order to allow the radial emission blade 1501 to distribute moist air, thus allowing for humidity moderation to be achieved. Said misting jets may alternatively be disposed within the blade shaft 1506 to ensure suitable distribution of mist into the radial emission blade 1501 for appropriate radial distribution.

Figures 16A, 16B, 16C:
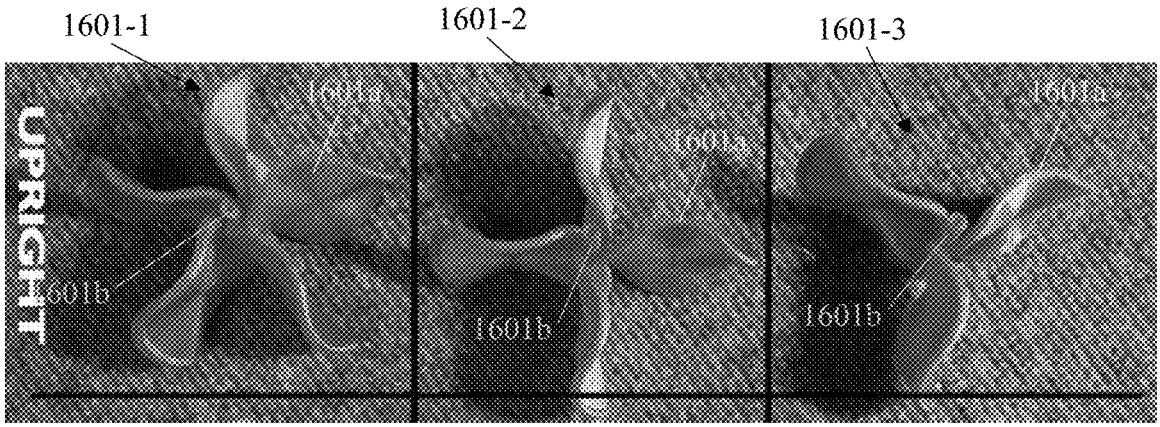
FIGS. 16A-16I illustrate the top perspective views of a plurality of radial emission blade embodiments, according to an aspect.
Figures 16D, 16E, 16F:
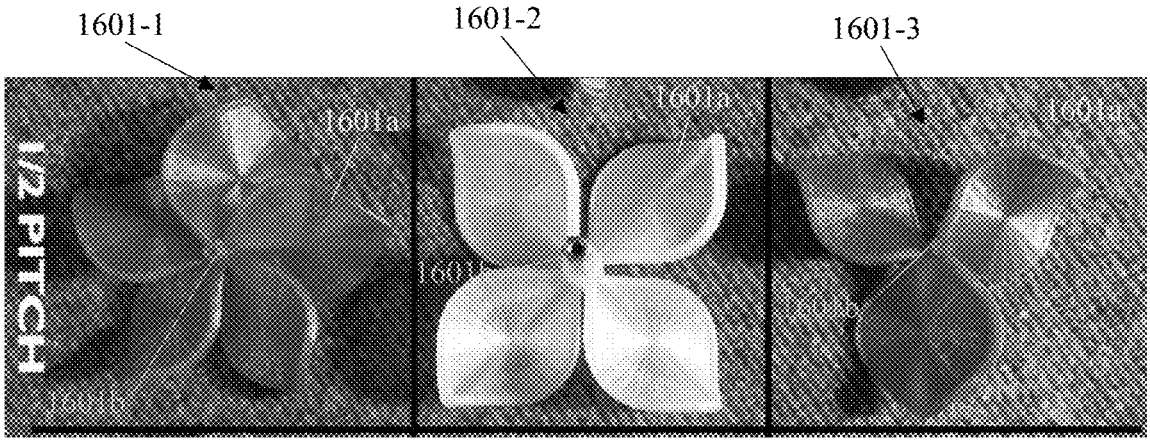
Figures 16G, 16H, 16I:
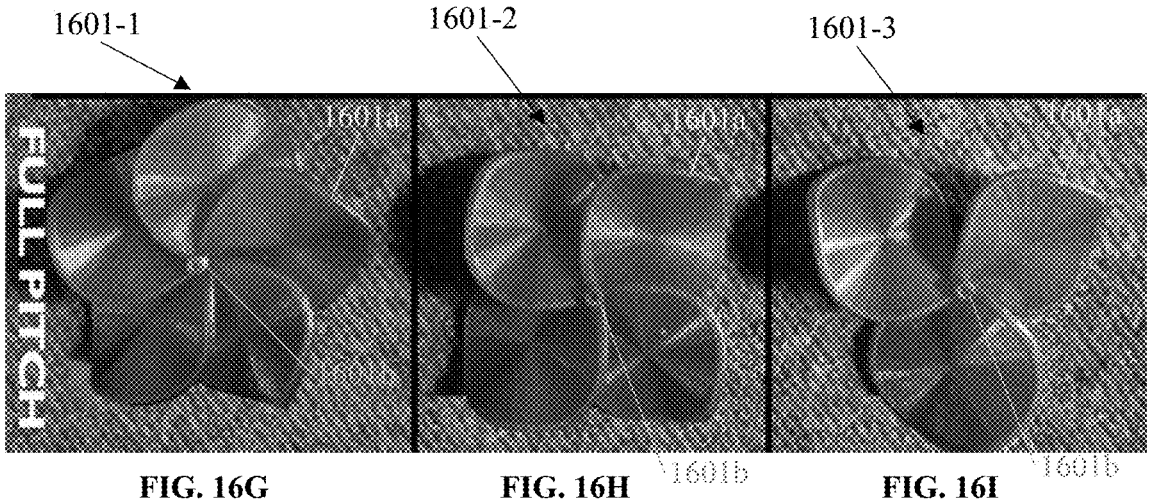

FIGS. 16A-16I illustrate the top views of a plurality of radial emission blade embodiments, according to an aspect. As can be seen in FIGS. 16A-16I, the quantity and pitch angles of the fins 1601*a* of a blade may be modified depending on the needs of an application. FIGS. 16A, 16B and 16C show a five fin blade 1601-1, a four fin blade 1601-2 and a three fin blade 1601-3, respectively, wherein said blades are configured to have an upright or "neutral" pitch angle, as described previously in FIG. 8. FIGS. 16D, 16E and 16F show a five fin blade 1601-1, a four fin blade 1601-2 and a three fin blade 1601-3, respectively, wherein said blades are configured to have a "half" pitch angle, wherein each fin of each blade is pitched to half of its maximum potential pitch angle. Finally, FIGS. 16G, 16H and 16I show a five fin blade 1601-1, a four fin blade 1601-2 and a three fin blade 1601-3, respectively, wherein said blades are configured to have a "full" pitch angle, wherein the pitch of each fin is maximized. It should be understood that the maximum pitch angle of a first fin may be limited based on the positioning of adjacent fins, which may block the pitching of said first fin. In an embodiment having a blade with fins comparable to those of FIG. 7C, wherein each fin 701*a* may attach to a fin hub 701*b* by a corresponding valley 714*b*-3, a preferred maximum pitch angle may be about 45 degrees in either direction (e.g., about 45 degrees clockwise or counterclockwise rotation of pitch angle of each fin.)

As disclosed hereinabove, manipulating the pitch angles of the fins of a blade may allow for the corresponding effective areas over which said blade pulls in and expels air (or another fluid/material) to be modified depending on the desired operating parameters of the blade. In an embodiment, changing the pitch angle of the fins 1601*a* may change the general direction of radial emission from straight out of the radial center (for a zero degree pitch angle, and thus radially emitted air flows orthogonally, or at a 90 degree angle, to the rotational axis) to more of a cone shaped flow pointing either up or down. As such, depending on the direction and extent of pitch angle, the angle of the radially expelled air may flow more upward or downward, such that the radially emitted air is no longer orthogonal to the rotational axis.

In an embodiment, a non-zero pitch angle for the fins 1601*a* of a blade 1601 may result in axially dispersed air tilting up or down, such that the axially emitted air is at an 80 degree angle to the rotational axis, a 100 degree angle to the rotational axis, or any other suitable angle, based on how the blade 1601 directs the intake air. In said embodiment, this may change flow from the middle to either direction (up or down) in a cone like shape. In an embodiment, the pitch angle of each fin 1601*a* may be adjusted in accordance with nearby obstructions (e.g., the floor, ceiling, other structures, etc.) to allow suitable mixing of a substance within a designated area. Again, this may also influence the ratio of fluid pulled in from above the blade to fluid pulled in from below the blade when the blade is rotated. The pitch angle may also be influenced by the portion of the sinusoidal outer edge of each fin that is associated with the fin hub 1601*b*. Removable fins or adjustment mechanisms may be implemented on each blade in order to facilitate changing of the pitch angle of each blade without replacing the fin hub 1601*b* as well. It should be understood that regardless of the quantity of fins utilized on a blade, the fins may be balanced such that safe and efficient rotation of the blade is possible.

Figure 17:
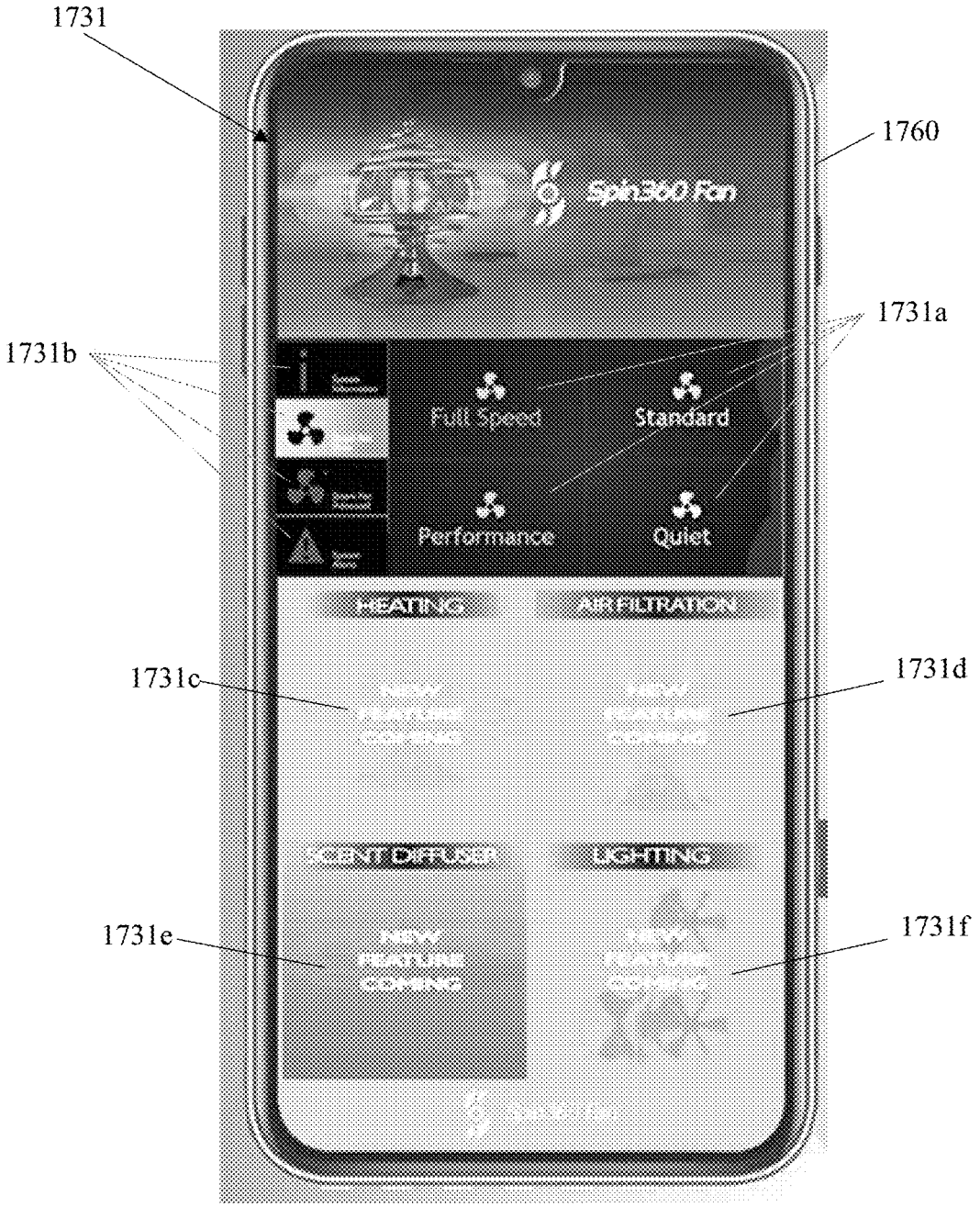
FIG. 17 illustrates an application interface for controlling an embodiment of the radial emission fan, according to an aspect.

FIG. 17 illustrates an application interface 1731 for controlling an embodiment of the radial emission fan, according to an aspect. The functions of the radial emission fan, such as radial emission fan 100 of FIG. 1, and each of its auxiliary elements, such as the accessory pod 1217 of FIG. 12, may be controlled by a user remotely using an appropriate device. In an embodiment, a radial emission fan having a Bluetooth receiver may be configured to interface with a suitable Bluetooth enabled device, such as smartphone 1760. This smartphone 1760 may be running an application ("app") having an application interface ("app interface") 1731 configured to allow a user to control different aspects of radial emission fan function. In an embodiment, the app interface may provide users with several buttons to press to control the functions of the radial emission fan, including but not limited to speed controller buttons 1731*a*, fan information and system toggle buttons 1731*b*, a heating/cooling element toggle button 1731*c*, an air filtration toggle button 1731*d*, a scent diffuser toggle button 1731*e* and a lighting device toggle button 1731*f*.

It should be understood that each button may influence device function in accordance with its provided description, e.g., the heating/cooling element toggle button 1731*c* may be utilized to turn on and turn off a heat/cooling element, such as heating element 1520 of FIG. 15, a lighting device toggle button 1731*f* may be utilized to turn on and turn off a light, etc. This app interface 1731 may also be expanded to include additional toggles for fan operation and auxiliary functions not described herein. By utilizing the described app, users may be provided with a fast, easy and remote method for adjusting their radial emission fan to their desired specifications.

Figure 18:
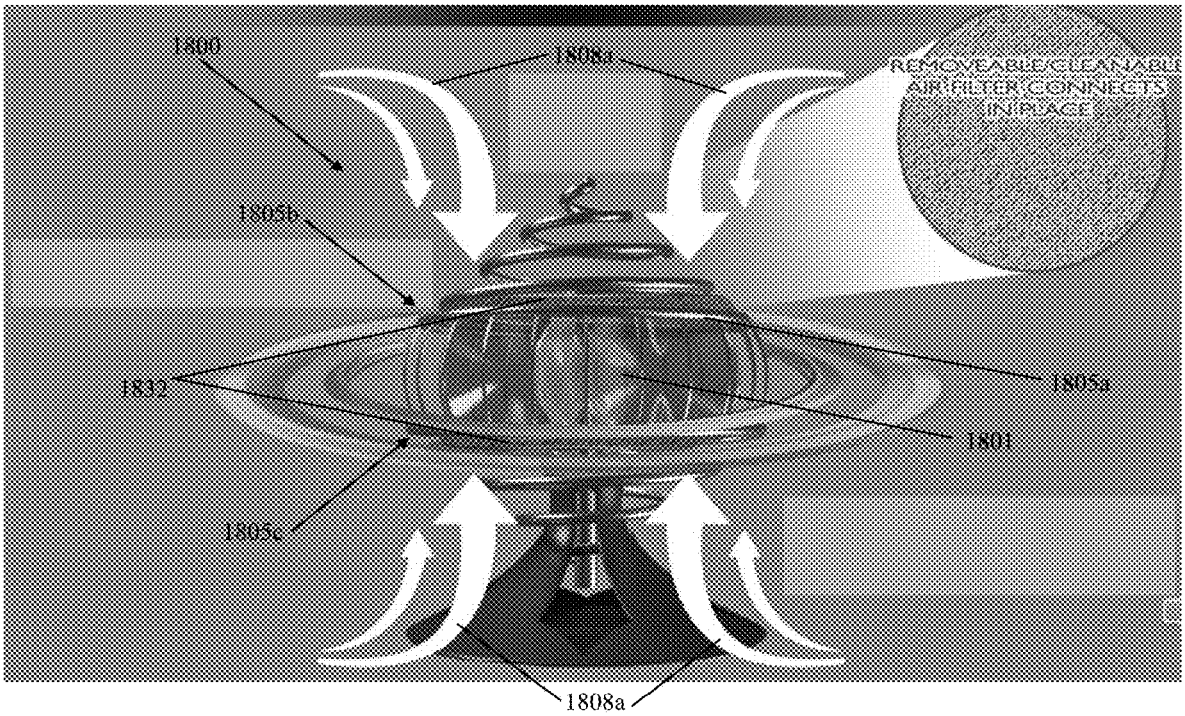
FIG. 18 illustrates the front perspective view of a radial emission fan having an axial intake air filter, according to an aspect.

FIG. 18 illustrates the front perspective view of a radial emission fan 1800 having an axial intake air filter 1832, according to an aspect. As disclosed hereinabove, it may be desirable to include a corresponding air filter on or within a radial emission fan 1800 in order to facilitate filtration of air (or another substance) within a space. In contrast to the previously disclosed radial exhaust air filter 1419 of FIG. 14, an axial intake air filter 1832 may not be configured to engage with the blade cage in the same manner. Each axial intake air filter 1832 may be configured to be disposed above or below the central blade cage 1805*a*, such that vortexes of axial intake air 1808*a* (or another material) that are axially pulled toward the blade 1801 may be filtered prior to entering the central blade cage 1805*a*. Each axial intake air filter 1832 may have a roughly cylindrical shape, wherein the radius of said cylindrical shape is the same as those of the upper/lower surfaces 1805*b*, 1805*c* of the central blade cage 1805*a*, such that each corresponding axial intake air filter 1832 may cover the entire upper/lower surfaces 1805*b*, 1805*c* of the central blade cage 1805*a*.

In an embodiment, two axial intake air filters 1832 may be utilized, wherein a first axial intake air filter 1832 is disposed above and engaged with the upper surface 1805*b* of the central blade cage 1805*a* and a second axial intake air filter 1832 is disposed below and engaged with the lower surface 1805*c* of the central blade cage 1805*a*. Depending on the needs and interests of the user, for applications requiring filtering of the air within an environment, the user may elect to use either a radial exhaust air filter, such as radial exhaust air filter 1419 of FIG. 14, the axial intake air filters 1832 or both the radial exhaust air filter and the axial intake air filters 1832 in the same radial emission fan 1800. It should be understood that each air filter, such as the axial intake air filters 1832, may be configured to be selectively removed for cleaning, as necessary.

It should be understood that any element configured to be directly manipulated by the incoming air, or configured to directly manipulate the incoming air/outgoing air may need to be positioned such that it is in the path of the incoming pulled air or the outgoing pushed air. For example, a scented accessory pod may be positioned within an accessory pod slot, such as accessory pod slot 104 of FIG. 1, such that the scented accessory pod is in the path of an intake air vortex disposed below the blade, such as vortex 2008*c* of FIG. 20. Similarly, the heating element 1520 of FIG. 15 may be positioned such that it too is in the path of two vortexes traveling toward the blade 1801 of the apparatus. As is understood the axial intake air 1832 filters may be in the direct path of the opposing vortexes, whereas the radial exhaust air filter 1419 of FIG. 14 may be indirectly in the path of the vortexes, thus manipulating the air from the opposing vortexes after it has been mixed and pushed out radially. Again, elements that directly manipulate the air flowing toward and away from the blade 1801 may be configured to be disposed somewhere along the path of the incoming or outgoing air, such as in the path of the incoming air intake vortexes.

Figure 19A:
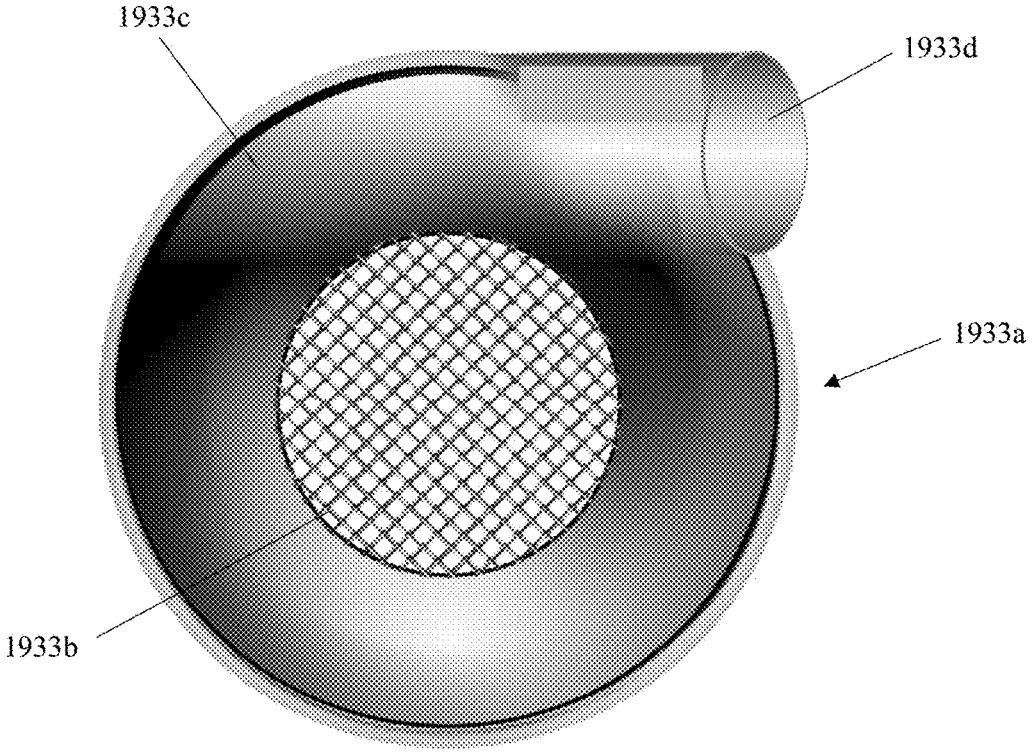
FIG. 19A illustrates the top view of a pump shell, according to an aspect.
Figure 19B:
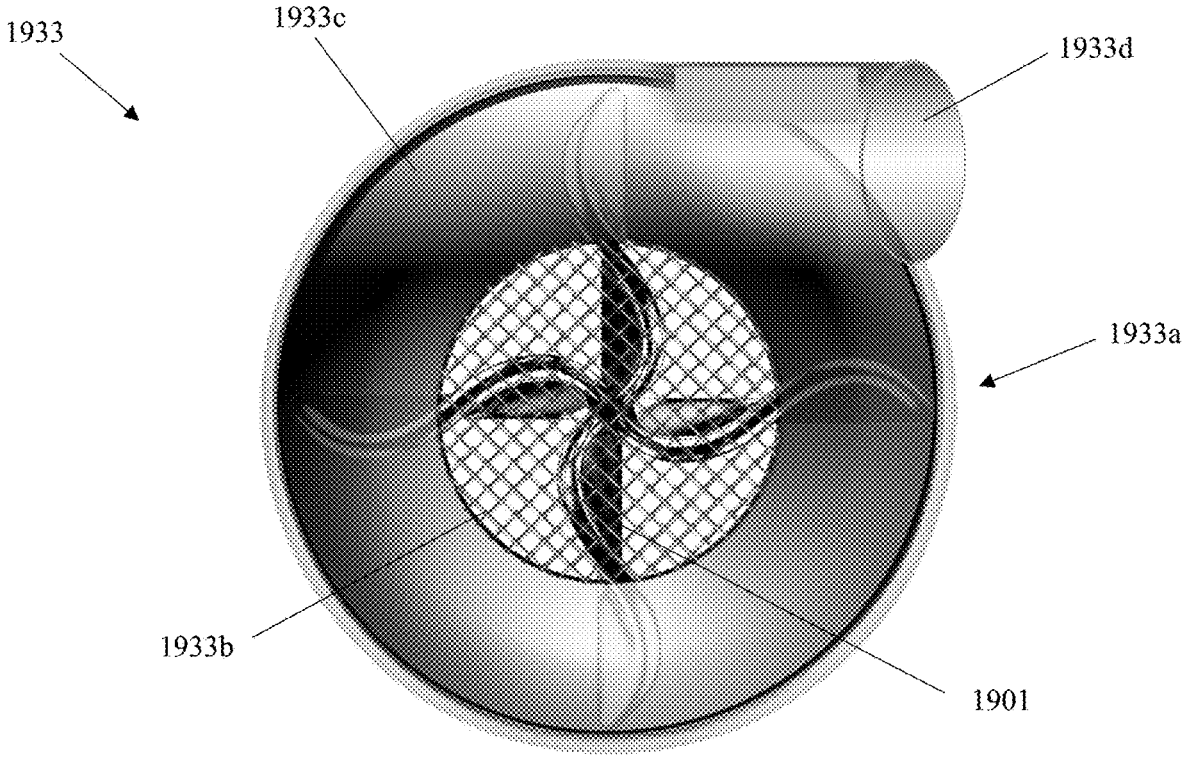
FIGS. 19B-19C illustrate the top and side views, respectively of a pump assembly utilizing the disclosed pump shell and radial emission blade, according to an aspect.
Figure 19C:
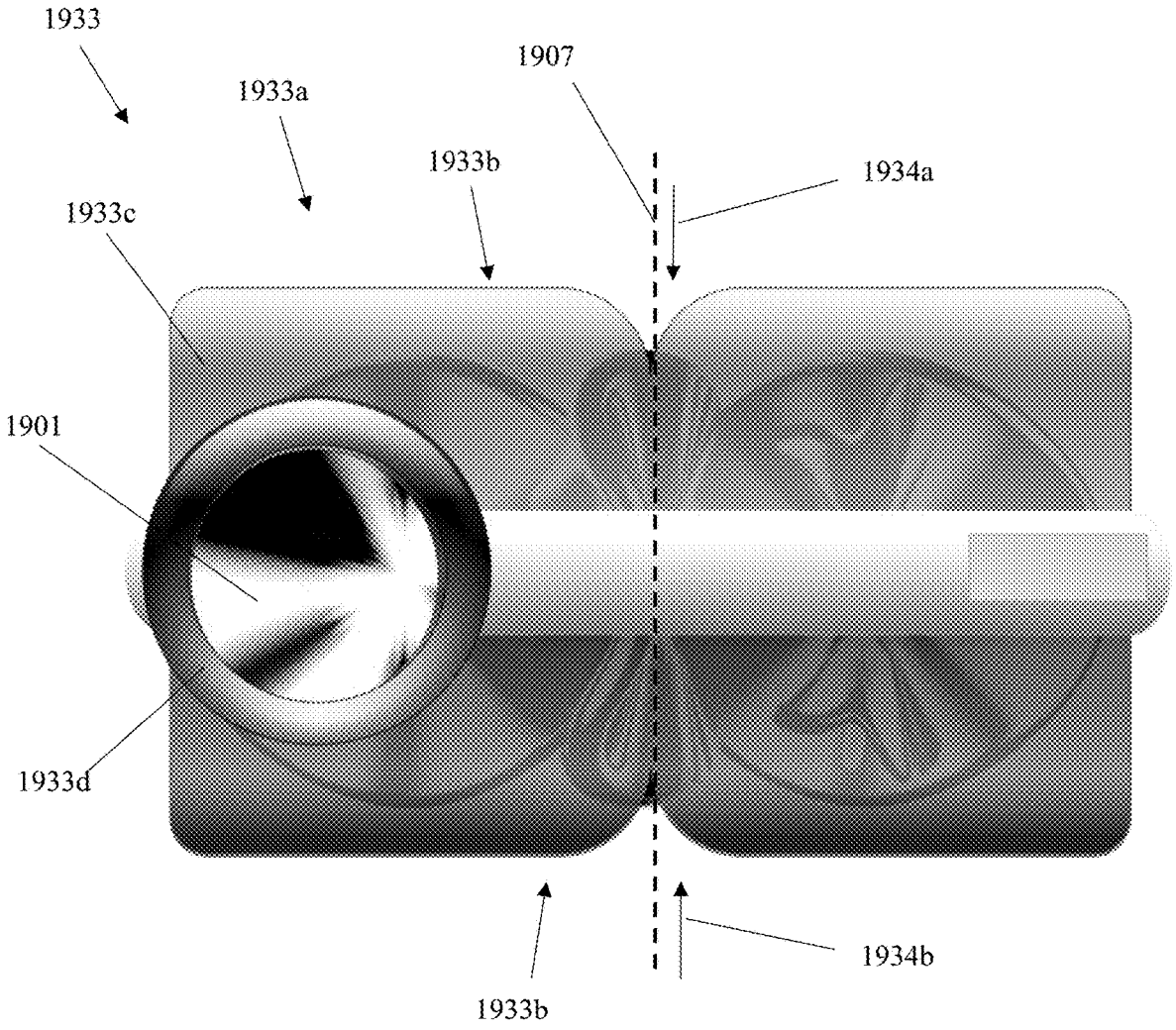

FIG. 19A illustrates the top view of a pump shell 1933*a*, according to an aspect. FIGS. 19B-19C illustrate the top and side views, respectively of a pump assembly 1933 utilizing the disclosed pump shell 1933*a* and the radial emission blade 1901, according to an aspect. As disclosed hereinabove, while the disclosed radial emission blade 1901 may often be described herein as being a component of a fan assembly configured to manipulate the flow of air, said blade 1901 of may also be utilized in a variety of other applications. As seen in FIG. 19B-19C, the disclosed blade 1901 may be included as a portion of a pump assembly 1933. It should be understood that the rotational axis for the top view of the pump assembly 1933 of FIG. 19B may be travelling into and out of the page through the fin hub 1901*b*, for consistency with the rotational axis 1907 shown in FIG. 19C.

In an embodiment, the pump assembly 1933 may comprise a pump shell 1933*a*, a radial emission blade 1901 nested with the pump shell 1933*a*, and an engine (not shown) or comparable structure associated with and configured to rotate the blade 1901. The pump shell 1933*a* may have two axially disposed intake grates 1933*b*, a rounded pump guard 1933*c* disposed between and engaged with the intake grates 1933*a*, and a radially disposed output port 1933*d* in fluid communication with the rounded pump guard 1933*c*. As such, upon rotation of the blade 1901, a material, such as water, may be pulled into the pump assembly 1933 through both axially disposed intake grates 1933*b* on the pump shell 1933*a*, and directed through the rounded pump guard 1933*c*, before being radially expelled out of the radially disposed output port 1933*d*.

In an embodiment, this disclosed pump assembly 1933 may be utilized as a pump for one or more pools. For an embodiment having two pools, the pump assembly 1933 may be positioned between the two pools, such that a singular pump assembly 1933 may be utilized to receive water from both pools. In said embodiment, the pump assembly 1933 may be configured to withdraw water from one pool from a first axial direction 1934*a* along the rotational axis 1907 and to withdraw water from a second pool from a second axial direction 1934*b* along the rotational axis 1907. The water that then flows through the radially disposed output port 1933*d* may be suitable returned to both pools by splitting and redirecting the resultant output stream leaving the output port 1933*d*, accordingly. This arrangement may require less machinery (e.g., only a singular pump) to facilitate the necessary pumping operations for two different pools.

In another embodiment, the disclosed pump assembly may be utilized for pumping water from a singular pool. The pump assembly 1933 may be disposed within the pool such that water from said pool may be pulled into the pump shell 1933*a* from both axial directions 1934*a*, 1934*b*. In this way, the disclosed pump assembly 1933 may be configured to continue pumping water through the intake grates 1933*b* into the pump shell 1933*a* even if one of the intake grates is blocked by debris. As such, by utilizing two different axial intake directions 1934*a*, 1934*b*, pump intake may be maintained to ensure consistent pumping of water for the pool.

It should be understood that a comparable pump assembly 1933 may be utilized in a hair dryer or other similar air pumping device. The described dual directional intake may also prove beneficial when using the pump assembly 1933 as part of a hair dryer or other air pumping device. As a result air being pulled into the pump assembly 1933 from the two different axial directions 1934*a*, 1934*b*, even if one intake grate 1933*b* is blocked, effective pumping may be maintained. It should be noted that such a pump assembly may be utilized for the pumping of all suitable materials, not just the water or air described hereinabove. By pulling in air from both axial directions 1934*a*, 1934*b* at once, a high pressure stream of material may be forced through a corresponding aperture, such as output port 1933*d*, for efficient movement of the corresponding material. As is understood, having the blade 1901 in a corresponding substance/material may allow the rotation of the blade 1901 to manipulate or otherwise control the flow or movement of the substance. This manipulation of the substance may be further controlled or adjusted by additional structures and features, such as the pump shell 1933*a*, an air shield, such as air shield 1318 of FIG. 13, etc.

Figure 20:
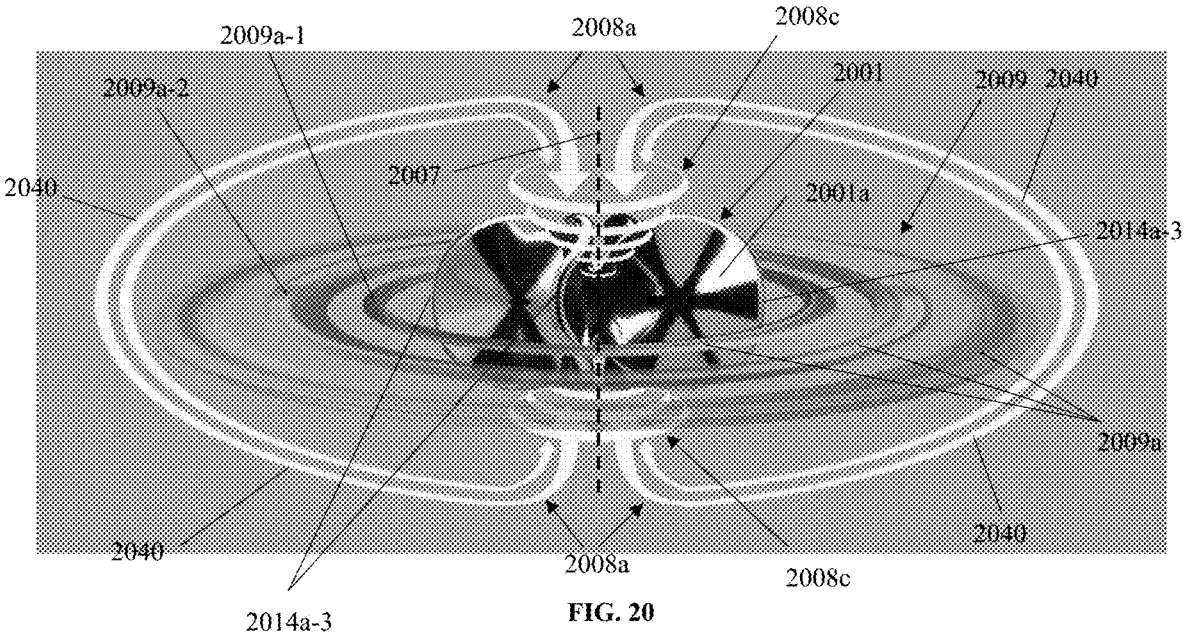
FIG. 20 illustrates the front perspective view of a radial emission blade showing material flow during clockwise rotation, according to an aspect.

FIG. 20 illustrates the front perspective view of a radial emission blade 2001 showing material flow during clockwise rotation, according to an aspect. As disclosed hereinabove, as the radial emission blade 2001 rotates clockwise, it may be configured to intake axially disposed materials, such as air, liquid, granular solids, etc. from above and below the radial emission blade 2001 and exhaust, emit or otherwise expel said materials radially away from the rotational axis 2007 of the blade 2001. Depending on how the radial emission blade 2001 and its fins 2001*a* are configured, the shape and characteristics of the expelled material, as well as the overall flow of materials into, out of and back into the radial emission blade 2001 may follow a specific pattern. For the present embodiment, air will be the material that is mixed by the rotation of the blade 2001, but it should be understood that any suitable material may also be mixed by the rotation of the blade 2001, as disclosed herein.

As seen in FIG. 20, as the blade 2001 rotates clockwise, it may pull in or ingest axially disposed intake air 2008*a* from above and below the blade 2001. This ingested, axially disposed air may be pulled into the blade 2001 in corresponding vortex 2008*c* above and below the blade 2001, wherein said vortexes 2008*c* may each have a conical shape. After the intake air 2008*a* is pulled into the blade 2001, it may then be emitted radially outward away from the rotational axis 2007 of the blade 2001. As seen in FIG. 20, this radially emitted output air 2009 may be emitted as successive air rings ("air pulses", "air ripples") 2009*a*, wherein each air ring 2009*a* has a toroidal shape. These toroidally shaped air pulses 2009*a* may be thrown outwardly from the most radially distal portion of each fin 2001*a*, which the shown embodiment of FIG. 20, would be the crest of the third hill 2014*a*-3 of each fin 2001. Each toroidally shaped air pulse 2009*a* may be configured to push out previously generated toroidal air pulses 2009*a*, such that continuous rotation of the blade 2001 is configured to continuously generate and expel toroidal air pulses 2009*a*. For example, a newest air toroidal air pulse 2009*a*-1 may be configured to push a second newest toroidal air pulse 2009*a*-2 radially outwards away from the rotational axis 2007. As the blade 2001 continuously rotates, each fin 2001*a* may generate a resultant air ring 2009*a*, wherein the following fin 2001*a* (e.g., the next fin 2001*a* to reach the same position as the original fin, based on rotational direction) may generate a newer air ring 2009*a* configured to propel the previously generated air ring 2009*a* radially outward. Again, it should be understood that the blade 2001 may be rotating in a clockwise direction, as shown in FIG. 6, for the current embodiment. In an embodiment having a blade 2001 comparable to that of FIG. 20, while the blade 2001 may perform similarly when rotating in either direction (clockwise or counterclockwise), depending on the configuration of the blade 2001, said blade 2001 may experience better performance and generate less noise when rotating in a clockwise direction.

The recycled air 2040 may also be shown in FIG. 20 to provide an overall view of the emitted output air 2009 flowing back to an axial position to be re-ingested by the blade 2001. As can be seen, once the output air 2009 is pushed away from the blade 2001 as toroidally shaped air pulse, this emitted air 2009 may flow back up and down, respectively, to axial positions above and below the blade 2001, to be ingested again as intake air 2008*a*. In short, air may be ingested as intake air 2008*a*, radially expelled as output air 2009 and may follow an exhaust flow stream as recycled air 2040 to return to its original axial position to be taken in again as intake air 2008*a*. As can be seen in FIG. 20, air that begins as recycled air 2040 that flows back to the axial positions and is ingested by the blade 2001 as intake air 2008*a* may follow a "toroidal path" and thus form a toroidal pattern, wherein said toroidal pattern is coaxially aligned with the rotational axis 2007. As such, the pulled and pushed air from the mixing/distributing of the disclosed apparatus forms a toroid, as shown in FIG. 20. It should be understood that this recycled air 2040 utilized as part of the "toroidal path" may depict a simplified representation of airflow that may only show a cross-section (e.g., a planar view) of the 360 degree toroid of air cycling through the blade 2001 as it rotates. This particular mechanism for ingestion of radially disposed intake air 2008*a* and expulsion of toroidal air rings may be configured to efficiently mix the air, or whichever material is being manipulated by the blade 2001.

Figure 21:
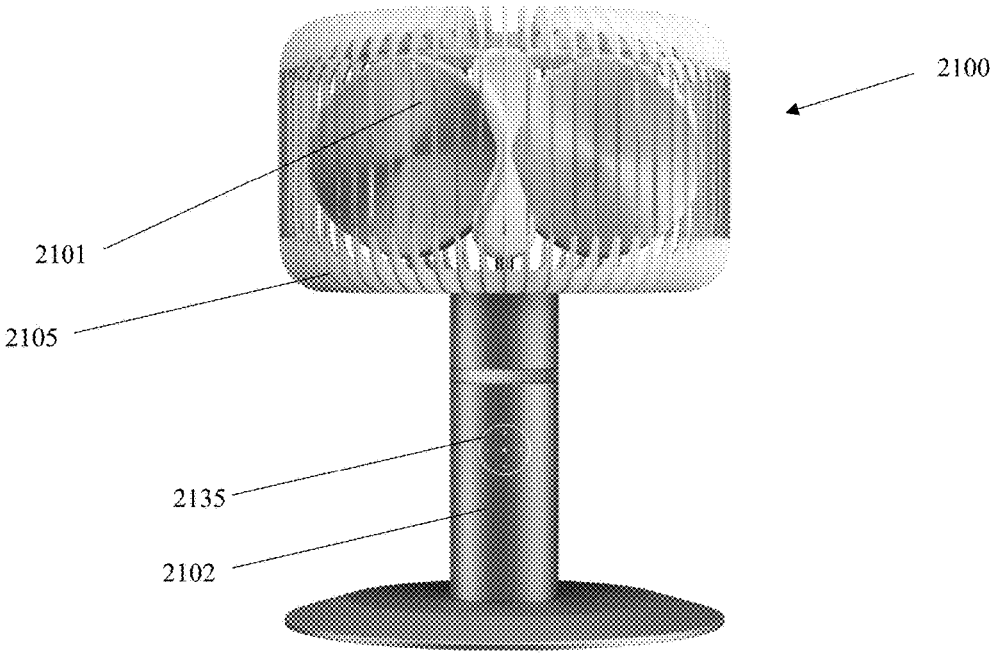
FIG. 21 illustrates the front perspective view of an alternative embodiment of the radial emission fan, according to an aspect.

FIG. 21 illustrates the front perspective view of an alternative embodiment of the radial emission fan 2100, according to an aspect. It should be understood that the shape, characteristics and features of the fan base 2102 and blade cage 2105 of a radial emission fan may be modified in accordance with the needs and desires of the user. For example, as seen in FIG. 21, the fan base 2102 may be provided as a cylindrical shape having an electronic interface 2135 for manipulating the radial emission fan 2100. In this embodiment, the fan base 2102 may also omit the accessory pod slot, such as accessory pod slot 1204 of FIG. 12, if not necessary. Furthermore, the shape of the blade cage 2105 may also be modified such that the blade cage 1205 has a simplified shape. As can be seen in FIG. 21, this embodiment of the blade cage 1205 may create a roughly cylindrical shell around the blade 2101, to protect the blade 2105 during rotation. It should be understood that various modifications to the shape and general appearance of the fan base 1202 and the blade cage 1205 may be made without negatively influencing device function.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. An apparatus for manipulating a substance, the apparatus comprising:

a blade having a fin hub associated with a fin, the fin being formed by a continuous sinusoidal outer edge and a continuous inner surface extending from the sinusoidal edge to a center of the fin, wherein the continuous sinusoidal outer edge surrounds the continuous inner surface, the fin hub being associated with a portion of the sinusoidal outer edge of the fin, such that to cause the fin hub and the fin to rotate simultaneously about a rotational axis that is coaxial with the fin hub;

a base that is rotationally associated with the fin hub;

wherein, when the blade rotates about the rotational axis in said substance, said substance is simultaneously pulled in via two opposing vortexes that are coaxial with the rotational axis, toward said portion of the sinusoidal outer edge of the fin, and said substance is also simultaneously pushed out 360 degrees around and away from the rotational axis.

2. The apparatus of claim 1 wherein the blade has at least two fins associated with the fin hub.

3. The apparatus of claim 1 wherein the apparatus is adapted to operate as a fan for mixing or distributing air.

4. The apparatus of claim 3 wherein the pulled and pushed air from the mixing or distributing of the apparatus forms a toroid.

5. The apparatus of claim 1 wherein the apparatus is adapted to operate as a fan that can disperse air radially in successive toroidal air rings.

6. The apparatus of claim 1 wherein a projection of the outermost points of the fin is circular.

7. The apparatus of claim 1 wherein the fin hub is associated with the portion of the sinusoidal outer edge of the fin at a zero degree pitch angle.

8. The apparatus of claim 1 wherein the fin hub is removably associated with the corresponding portion of the sinusoidal outer edge of the fin.

9. The apparatus of claim 1 wherein at least one of a scented accessory pod, a heating element, a cooling element and a filter is placed in the path of one or both opposing vortexes.

10. The apparatus of claim 1 wherein the apparatus comprises at least two coaxial blades.

11. The apparatus of claim 1, further comprising an air shield associated with the base, such that the air shield is configured to reduce the 360 degree angle at which the substance is pushed out of the apparatus.

12. An apparatus for manipulating a substance, the apparatus comprising:

a blade having a fin hub associated with a fin formed by a sinusoidal outer edge and an inner surface extending from the sinusoidal edge to a center of the fin, wherein the sinusoidal outer edge surrounds the inner surface, the fin hub being associated with a portion of the sinusoidal outer edge of the fin, such that to cause the fin hub and the fin to rotate simultaneously about a rotational axis that is coaxial with the fin hub;

wherein, when the blade rotates about the rotational axis in said substance, said substance is simultaneously pulled in via two opposing vortexes that are coaxial with the rotational axis, toward said portion of the sinusoidal outer edge of the fin, and said substance is also simultaneously pushed out 360 degrees around and away from the rotational axis.

13. The apparatus of claim 12 wherein a projection of the outermost points of the fin is circular.

14. The apparatus of claim 12 wherein the sinusoidal outer edge is continuous.

15. A blade comprising:

a fin having a sinusoidal outer edge and an inner surface extending from the sinusoidal edge to the center of the fin, wherein the sinusoidal outer edge surrounds the inner surface; and a fin hub associated with the fin.

16. The blade of claim 15 wherein a projection of the outermost points of the fin is circular.

17. The blade of claim 15 wherein the inner surface is continuous.

18. The blade of claim 15 wherein two opposing fins disposed on the X-axis of the blade and two opposing fins disposed on a Y-axis of the blade are associated with the fin hub.

19. The blade of claim 15 wherein the fin hub is associated with the fin at a zero degree pitch angle.

20. The blade of claim 15 wherein the sinusoidal outer edge is continuous.

* * * * *